US011344135B2

(12) United States Patent
Gates et al.

(10) Patent No.: US 11,344,135 B2
(45) **Date of Patent: *May 31, 2022**

(54) SOFA WITH UPHOLSTERY COVER HAVING ATTACHMENT MEANS

(71) Applicant: Ashley Furniture Industries, LLC, Arcadia, WI (US)

(72) Inventors: Earnest Gates, New Albany, MS (US); Steve Koon, New Albany, MS (US); James Anthony Sudduth, Thaxton, MS (US); James A. Lewis, Pontotoc, MS (US); Wayne Bramlitt, Ecru, MS (US)

(73) Assignee: Ashley Furniture Industries, LLC, Arcadia, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/131,320

(22) Filed: Dec. 22, 2020

(65) Prior Publication Data

US 2021/0177159 A1 Jun. 17, 2021

Related U.S. Application Data

(63) Continuation of application No. 16/281,774, filed on Feb. 21, 2019, now Pat. No. 10,869,560.
(Continued)

(51) Int. Cl.
*A47C 31/02* (2006.01)
*A47C 7/00* (2006.01)
(Continued)

(52) U.S. Cl.
CPC ..... *A47C 31/04* (2013.01); *A47C 17/02* (2013.01); *A47C 17/86* (2013.01)

(58) Field of Classification Search
CPC ..... A47C 17/02; A47C 17/86; A47C 31/023; A47C 31/04; A47C 31/11; A47C 4/028; A47C 31/02
See application file for complete search history.

(56) References Cited

U.S. PATENT DOCUMENTS 2,029,247 A * 1/1936 Mercogliano ..... A47C 7/14 248/598
2,383,687 A 8/1945 Saltz
(Continued)

FOREIGN PATENT DOCUMENTS

DE 3513076 A1 10/1986
DE 3513076 C2 10/1986
(Continued)

OTHER PUBLICATIONS

International Search Report for Application No. PCT/US2019/18964, dated Jul. 30, 2019 (5 pages).
(Continued)

*Primary Examiner* — Shin H Kim
(74) *Attorney, Agent, or Firm* — Christensen, Fonder, Dardi & Herbert PLLC

(57) ABSTRACT

An upholstered sofa comprises a sofa frame covered with fitted upholstery. The fitted upholstery provided by a form fit upholstery cover or covers formed of upholstery material and comprising stitched upholstery panels and pieces, the cover having upholstery edge portions with attachment means for securement of the edge portion without staples to the sofa frame. The attachment means may be a resilient polymer channel sewn to the upholstery material. The attachment means may be a plurality of elastic cords with connectors on distal ends of the cords. The elastic cords may be stretched and attached to features on the sofa frame or to features on the upholstery cover thereby keeping the upholstery cover assembly taught on the sofa frame.

16 Claims, 25 Drawing Sheets

Related U.S. Application Data

(60) Provisional application No. 62/774,852, filed on Dec. 3, 2018, provisional application No. 62/633,575, filed on Feb. 21, 2018.

(51) Int. Cl.

| | |
|---|---|
| ***A47C 31/04*** | (2006.01) |
| ***A47C 17/86*** | (2006.01) |
| ***A47C 17/02*** | (2006.01) |

(56) References Cited

U.S. PATENT DOCUMENTS

| | | | | |
|---|---|---|---|---|
| 2,531,047 | A | 11/1950 | Holsinger | |
| 2,588,058 | A | 3/1952 | Thompson et al. | |
| 3,188,137 | A * | 6/1965 | Sarvas | A47C 17/12 297/218.3 |
| 3,311,408 | A | 3/1967 | Sarvas | |
| 3,438,099 | A | 4/1969 | Green | |
| 3,608,959 | A | 9/1971 | Sarvas | |
| 3,653,712 | A | 4/1972 | Sarvas | |
| 3,794,378 | A | 2/1974 | Haslam et al. | |
| 3,842,456 | A | 10/1974 | Bronstien, Jr. | |
| 3,867,730 | A | 2/1975 | Wright | |
| 3,871,041 | A | 3/1975 | Plume | |
| 3,928,898 | A | 12/1975 | Smoot | |
| 4,065,182 | A | 12/1977 | Braniff et al. | |
| 4,396,226 | A | 8/1983 | Haack | |
| 4,602,817 | A | 7/1986 | Raftery | |
| 4,676,549 | A | 6/1987 | English | |
| 4,789,201 | A | 12/1988 | Selbert | |
| 5,288,136 | A | 2/1994 | Webber et al. | |
| 5,403,066 | A | 4/1995 | Drum | |
| 5,518,292 | A | 5/1996 | Cozzani | |
| 5,529,380 | A | 6/1996 | Blansett | |
| 5,570,930 | A | 11/1996 | LaPointe et al. | |
| 5,664,832 | A | 9/1997 | Stevens et al. | |
| 5,729,241 | A | 3/1998 | Ergen et al. | |
| 5,768,758 | A | 6/1998 | Deignan et al. | |
| 5,820,213 | A | 10/1998 | Severinski | |
| 5,826,939 | A | 10/1998 | Beyer | |
| 6,155,280 | A | 12/2000 | Powell et al. | |
| 6,409,264 | B1 | 6/2002 | Palmer et al. | |
| 6,490,767 | B2 | 12/2002 | Haiduk | |
| 6,543,843 | B1 | 4/2003 | Moilanen | |
| 6,592,181 | B2 | 7/2003 | Stiller et al. | |
| 6,745,444 | B2 | 6/2004 | Moilanen | |
| 6,827,407 | B2 | 12/2004 | Niederman et al. | |
| 6,880,794 | B1 | 4/2005 | Kahn | |
| 6,976,737 | B1 | 12/2005 | Dandolo | |
| 7,040,700 | B2 | 5/2006 | Duncan et al. | |
| 9,089,224 | B1 | 7/2015 | Baker et al. | |
| 9,332,858 | B1 | 5/2016 | Chiang et al. | |
| 9,420,896 | B2 | 8/2016 | Fifer, III et al. | |
| 9,446,698 | B2 | 9/2016 | Ushiyama | |
| 9,565,949 | B2 | 2/2017 | Peterson | |
| 9,707,426 | B2 | 7/2017 | Tsai | |
| 10,034,554 | B2 * | 7/2018 | Lewis | A47C 17/02 |
| 10,065,577 | B2 | 9/2018 | Braggion et al. | |
| 10,117,521 | B2 | 11/2018 | Lewis et al. | |
| 2003/0151293 | A1 | 8/2003 | McLarty et al. | |
| 2003/0224884 | A1 | 12/2003 | Oister et al. | |
| 2006/0012228 | A1 * | 1/2006 | Bardouche | A47C 31/11 297/228.12 |
| 2006/0249998 | A1 | 11/2006 | Westendorf et al. | |
| 2010/0001565 | A1 | 1/2010 | Gray et al. | |
| 2013/0316876 | A1 | 11/2013 | Publicover et al. | |
| 2014/0091609 | A1 | 4/2014 | Van Der Jagt et al. | |
| 2014/0265483 | A1 * | 9/2014 | Miller | A47C 31/11 297/228 |
| 2014/0375103 | A1 | 12/2014 | Lejcher et al. | |
| 2015/0135485 | A1 | 5/2015 | Santin et al. | |
| 2016/0325659 | A1 | 11/2016 | Taguchi et al. | |
| 2017/0105545 | A1 | 4/2017 | Lewis et al. | |
| 2017/0284117 | A1 | 10/2017 | Volin | |
| 2018/0142717 | A1 | 5/2018 | Ejdemo | |
| 2019/0254440 | A1 | 8/2019 | Gates et al. | |
| 2019/0290017 | A1 | 9/2019 | Ross et al. | |

FOREIGN PATENT DOCUMENTS

| | | | |
|---|---|---|---|
| EP | 0089708 | A2 | 9/1983 |
| EP | 0609165 | A1 | 8/1994 |
| FR | 2964349 | A1 | 3/2012 |
| FR | 2964349 | B1 | 2/2014 |
| GB | 788686 | A | 1/1958 |
| GB | 895550 | A | 5/1962 |
| GB | 969452 | A | 9/1964 |
| GB | 1126734 | A | 9/1968 |
| GB | 2135573 | B | 9/1984 |
| GB | 2426034 | B | 7/2006 |
| GB | 2426034 | A | 11/2006 |
| WO | WO2015154096 | A2 | 10/2015 |
| WO | WO2018081471 | A1 | 5/2018 |

OTHER PUBLICATIONS

"Elastics/Cord" (MSM) Jul. 8, 2009. Retrieved from the Internet on Apr. 8, 2019. URL https://www.mispecmonkey.com/customize/elasticscord. (3 pages).

* cited by examiner

SOFA WITH UPHOLSTERY COVER HAVING ATTACHMENT MEANS

CROSS-REFERENCE TO RELATED APPLICATIONS

This application is a continuation of U.S. patent application Ser. No. 16/281,774 filed Feb. 21, 2019, now U.S. Pat. No. 10,869,560. Said patent and application claims the benefit of U.S. Provisional Application No. 62/774,852, filed Dec. 3, 2018, and U.S. Provisional Application No. 62/633,575, filed Feb. 21, 2018, the entire contents of which are incorporated by reference herein.

FIELD OF THE DISCLOSURE

This disclosure relates to furniture construction, and in particular, to the manufacture of upholstered furniture. More specifically, the disclosure relates to upholstery covers form fit to conventional wooden sofa frames and the integration of fastening means on the covers facilitating easy attachment to the frames.

BACKGROUND

In the manufacture of upholstered furniture, such as sofas, by way of example, love seats, chairs, and similar items, upholstery fabrics are typically secured to a frame through fixed fastening means.

Upholstery fastening means for sofas and chairs typically, by way of example, involve the use of fasteners, typically staples, but also including tacks, nails, screws, or other similar fasteners. Because these fasteners have a low tolerance for correction, the upholstery must be perfectly aligned before it is fastened to the frame. Such fastening is serial, that is, one after another such that only an incremental portion of the upholstery is attached at a time. This can require continual alignment and positioning of the upholstery edge portions as they are attached. Moreover, the fabric and materials used for upholstery typically has some degree of stretchability such that as the upholstery is attached it must be incrementally stretched. The currently employed methods of aligning the upholstery is very time consuming, and even minute errors can result in products with visible imperfections and inconsistency from one piece of furniture to the next. Thus training and skill levels are important for consistent quality product. Typically the edge portions are simply the cut edges of the upholstery fabric with no finishing such as folded over portions. The edge portions are of a non-critical length and simply stapled to exposed wood frame portions that are not readily visible, or that will be subsequently covered. For example, upholstery cover edge portions of the front, back, and arm rest sides of a sofa are pulled over the lower perimeter corner of a sofa frame and stapled to exposed wood on the bottom of the frame. These staples may be covered by a thin black dust cover that is also typically stapled to the frame.

Tools that can be required for applying the fasteners to the frame are relatively expensive, may be dangerous to operate, and require extensive training before operating. Securing the fabric may also require an exorbitant number of fasteners, driving up the cost to manufacture each piece of furniture. In some case, different installers utilize different numbers of fasteners to secure the fabric, resulting in difficulties tracking costs and materials, as well as yielding inconsistent results on the completed product. Further, after the upholstery is fastened to the frame, it is extremely time consuming to remove and replace for repairs. In some cases, removal attempts may permanently damage the upholstery fabric, the frame, or both.

Furniture manufacturers continually seek efficiencies in production costs. It is known to furniture manufacturers to manufacture upholstery kits overseas, the kits including upholstery covers form fit to portions of furniture frames. The upholstery kits are shipped back to the United States for installation on the furniture frames. The tedious, costly, and somewhat hazardous task of installing the upholstery pieces to the frame often occurs in the United States, remote from the manufacture of the upholstery kits. The installation of the upholstery covers to the wooden frames typically requires the use of many, for example, hundreds of staples per sofa with the quality of the cover install being highly dependent upon the skill and training of the installer. Minimizing labor and parts costs, particularly the more expensive labor costs in the U.S., and making the process safer, and making the process less dependent upon the training and skill of the upholstery cover installer, would result in better manufacturing efficiencies, more consistent quality sofas, better value for the consumer, and would be well received by the industry.

SUMMARY

The embodiments of the present disclosure include furniture items, such as a sofa, in which the number of fasteners required to secure upholstery is minimized, in which the furniture items are simple and safe to assemble, in which errors are minimized, in which the time for assembly is minimized, and in which the furniture items are aesthetically pleasing and uniform across multiple installations. A sofa is covered by upholstery provided by an upholstery kit. The kit having a plurality of form fit covers with edge portions having attachment means secured thereto, such as by sewing, that connect to features on the sofa frame, or to other attachment means on cover edge portions. A kit may have two, three, or four separate covers or sacks, for example, one for covering the front side and back side of the back rest frame portion; one sack for covering each of the two side arm frame portions; and one sack for covering the seat box frame portion. Each sack can have two, three, or more edge portions that have associated connectors sewn thereto. In embodiments, the majority of the length of simple exposed cut upholstery edges of a cover or sack will have been modified from the simple exposed cut edge to an edge portion with connector portions sewn thereto. In embodiments, the connectors may be semi rigid polymer channels sewn to the edge portions, elastic cords sewn to the edge portions, or straps sewn to the edge portions. A particular cover may have, for example, a channel on one edge portion, a series of elastic cords along another edge portion, and two edge portions with a simple exposed cut upholstery edges. The elastic cords may have rigid connector members secured thereto for connection on sofa frame features. The two or three separate covers or sacks for a sofa will be interconnected by way of the connectors on the edge portions. Certain edge portions of the two, three, or four covers will be attached with staples. A final finish dust cover may be stapled on the bottom of the sofa frame after all of the two, three, or four covers are secured to the sofa frame.

An upholstered sofa in accordance with embodiments comprises a sofa frame covered with fitted upholstery. The fitted upholstery provided by a form fit upholstery cover or covers comprising stitched upholstery panels and pieces, the cover having upholstery edge portions with resilient polymer channeled fastening strips attached thereto and extending substantially the length of such edges. The fastening strips may be J or U shaped when viewed from an end of the strip. In embodiments, the channeled fastening strips are stitched to the upholstery edge portions. The channeled fastening strips having channels that are sized to conform to wood frame members of the sofa frame. The wood frame members configured as wood boards having a rectangular cross section with four sides and four corners. The channeled fastening strips, when attached, conforming to three sides and two corners of each of the wood frame members. In embodiments, the channeled fastening strips may be held in place by the tautness of the fabric panels which pulls the fastening strip toward the upholstery portion to which it is attached capturing the J or U shaped strip on the respective wood frame member.

In embodiments edge portions with the fastening strips are attached on one side of the upholstery cover portion and then on an opposing side the edge portion of the cover with the resilient is pulled taut and the resilient polymer channeled fastening strip or strips on said edge portion is expanded to slide over a framed member to capture the frame member within a channel defined by the fastening strip.

In embodiments, the form fit upholstery cover is sewn together at a facility where upholstery and other fabric or materials are precisely patterned and sewn together as the form fit upholstery cover. At the same facility the resilient channeled fastening strips are precisely stitched or otherwise attached to edge portions of the upholstery cover. The assembled form fit upholstery cover with attached channeled fastening strips may then be stored and shipped to the final sofa assembly facility where it is assembled onto the sofa frame.

In embodiments, a wooden sofa frame having a rectangular seat base frame portion and an upright back rest frame portion integral with the seat base frame portion. The seat base frame portion has a generally rectilinear shape and forms a box frame portion, formed generally of wood boards, and having a left side, a right side, a front side, and a back side. The back rest frame portion is affixed to the back side of the seat base frame portion. The back rest frame portion further has a front side, a back side, a lower portion, a top rail, and a breast rail. The top rail and breast rail formed of wood boards. A form fit upholstery cover having a back material panel with a top edge portion and a bottom edge portion with a resilient polymer channeled fastening strip sewn thereto at the bottom edge portion. An embodiment of a form fit upholstery cover has a left side material panel having a top end and a bottom end, and a right side material panel having a top end and a bottom end. The form fit upholstery cover is disposed on the frame with at least one fastener strip of the upholstery cover secured to the frame at the lower portion of the back rest frame portion. In one embodiment, one or more fastener strips of the form fit upholstery cover secure cover to a top rail. In another embodiment, one or more fastener strips of the form fit upholstery cover secure the cover to a breast rail. In another embodiment, one or more fastener strips secures the form fit upholstery cover to a front panel. In another embodiment, one or more fastener strips secures the form fit upholstery cover to the lower portion of the right side. In another embodiment, one or more fastener strips secures the form fit upholstery cover to the lower portion of the left side. In another embodiment, one or more fastener strips secures the form fit upholstery cover to an aperture in the right side panel. In another embodiment, one or more fastener strips secures the form fit upholstery cover to an aperture in the left side panel.

A feature and advantage of embodiments of the invention is the rapid attachment of a form fit upholstery cover to the wood frame of a sofa with fastener strips. A feature and advantage of embodiments of the invention is the fastener strips securely engage the frame without the need of permanent fasteners such as staples. A few select staples may be used to positionally secure the fastener strips in place. A feature and advantage of embodiments of the invention is the fastener strips may be readily adjusted along the frame to provide the form fit upholstery cover with a uniform and consistent appearance, eliminating wrinkles or tautness. A feature and advantage of embodiments of the invention is that the fastener strips are readily removable from the sofa frame allowing for easy repair or replacement of the form fit upholstery cover. A feature and advantage of embodiments of the invention is the fastener strips pull and secure the upholstery fabric around frame members to create a visually appealing aesthetic.

A feature and advantage of embodiments is a channel, J-shaped or U-shaped, that may be stitched to upholstery piece edges with the same sewing equipment that is utilized to attach the upholstery pieces together at the upholstery manufacturing facility. At such facility, upholstery patterns and precision stitching capabilities of upholstery components are already in place; inventors have discovered that such precision stitching may be applied to stitchable resilient polymer channeled fastener strips to precisely locate the strips on the form fit upholstery cover edge portions for the subsequent easy, consistent, essentially error free assembly of the form fit cover to the wooden sofa frame. Thus, a feature and advantage is that the attachment of the channel fastener strips configured as U-shaped or J-shaped fasteners to the upholstery edge portion is readily and easily accomplished. Each fastener having opposing legs connected by a base leg, each leg having interior surfaces defining an interior channel region, and each leg having respective exterior surfaces. The upholstery may be attached on the exterior surface of any one of the three legs by stitching with a sewing machine.

In embodiments the fastener strips are thin with respect to their end or cross sectional length dimension, that is, the length dimension measured along the J or U shape transverse to the direction of the upholstery edge to which the respective fastener strip is attached. In embodiments the ratio is greater than 50:1; in embodiments, the ratio is greater than 80:1. In embodiments, the thickness, of the fastener strip is from 0.030 to 0.10 inches. In embodiments, the thickness of the fastener strip is 0.020 to 0.040 inches. In embodiments, the thickness of the fastener strip is 0.020 to 0.140 inches. In embodiments, the thickness of the fastener strip is 0.025 to 0.060 inches. In embodiments, the fastening strips are at least 12 inches long measured in the direction along which the upholstery edge portion is to be attached. In embodiments, the fastening strips are at least 18 inches long measured in the direction along which the upholstery edge portion is to be attached. In embodiments, the fastening strips are at least 8 inches long measured in the direction along which the upholstery edge portion is to be attached. In embodiments the fastening strips are 8 to 40 inches long. In embodiments the fastening strips are 12 to 30 inches long. In embodiments, the resilient polymer channeled fastening strips may be formed from a rectangular piece of polymer thermal formed into the elongate channel or in embodiments with a single angle. In embodiments, the resilient polymer channeled fastening strips may be extruded. In embodiments, the resilient polymer channeled fastening strips may be injection molded. Various thermoplastic polymers are suitable for the resilient strips including, but not limited to, polyvinyl chloride (PVC), polyurethanes, styrenes, acrylonitrile butadiene styrenes (ABS), polyethylenes (PE) including high density PE, polyamides, polycarbonates, polyesters, polypropylenes, and polystyrenes. In embodiments, other non-polymer resilient materials or composite materials may be utilized, including but not limited to formed fibrous pulp products including wood pulp products. In embodiments, the fastening strip may be formed of two different polymers or materials, for example, one material being more rigid for capturing the wood frame member and one material being more stitchable for stitching the upholstery thereto. The more rigid portion correlating with the lower U portion of a J shaped channel. The upper portion of the longer leg of the J shaped channel formed of the more stitchable material. See U.S. Pat. No. 5,826,939 incorporated by reference herein for all purposes. The two portions may be cojoined during a molding process, for example, during extrusion or injection molding, or otherwise connected or adhered to one another. In embodiments, the fastening strip may be formed of a third polymer or material along a portion of the channel in contact with the wood frame member where the third polymer or material has a higher coefficient of friction with the wood frame member than the first polymer or material in order to make it more difficult for the fastening strip to slide along the frame member.

In embodiments, a method of assembling an upholstered sofa includes providing a sofa frame with a rectangular seat, an upright back rest frame portion integral with the seat base frame portion, and a right arm rest and a left arm rest integral with the seat base frame portion and back rest frame portion, the seat base frame portion and back rest disposed between the right arm rest and the left arm rest, the sofa frame including a top rail at a top of the back rest and a lower rearward rail, the lower rearward rail having a rectangular cross section with four sides and four corners; positioning over the wooden sofa frame a form fit upholstery cover including a pocket portion for the upright back rest frame portion of the sofa frame, a back material panel including a top end and a bottom edge portion, an elongate fastener strip sewn between the top end and the bottom edge portion; placing a base including a front cover and one or more elastic fasteners disposed along the margin within the rectangular seat; feeding an elastic fastener through a receiving aperture in each of the left and right armrests; disposing the left armrest sock over the left armrest and the right armrest sock over the right armrest; pulling an elastic fastener affixed to the left armrest sock through the receiving aperture of the left armrest and an elastic fastener affixed to the right armrest sock through the receiving aperture of the right armrest such that the elastic fastener fed through from the base and the fasteners affixed to the left and right armrest socks are thereby secured to the sofa frame; capturing the wooden top rail within the elongate fastener strip; pulling a front wing elastic fastener through a notch in the right armrest; pulling a front wing elastic fastener through a notch in the left armrest; pulling a back wing elastic fastener around a left back post and through an aperture in the left armrest; pulling a back wing elastic fastener around a right back post and through an aperture in the right armrest; pulling an outside elastic fastener over the wing elastic fastener and through a notch in the left armrest; and pulling an outside elastic fastener over the wing elastic fastener and through a notch in the right armrest, such that the form fit upholstery cover is taught and uniformly disposed about the wooden sofa frame.

In embodiments, the method of assembling an upholstered sofa further includes securing an elastic fastener affixed to the margin of the front base to an elastic fastener affixed to the bottom edge portion of the rear material.

In embodiments, the method of assembling an upholstered sofa further includes securing an elastic fastener affixed to the margin of the front base to a sewn loop affixed to the bottom edge portion of the rear material.

A feature and advantage is a method of alignment of extended lengths of the edge portions of form fit upholstery covers on sofa frames comprising attaching a thin resilient polymer strip on to an edge portion of the upholstery cover to be attached, the polymer strip having at least one substantially a right angle corner extending the length of the strip whereby the installer extends and/or stretches the edge portion for the entirety of the length of the thin resilient polymer strip at one time during the attachment process of the upholstery cover to the wood frame. This replaces the tedious task of stretching and attaching small lengths, an inch or two, of the fabric per staple of a serial stapling operation.

A feature and advantage of embodiments herein is minimizing labor, particularly in the process of and where the sofa upholstery is installed on the wood sofa frame. Another feature and advantage is making the product manufacture safer, rather than requiring a multiplicity of staples to attach the sofa upholstery covers, minimal or in some cases no staples are required. A feature and advantage is that the quality of the installation of the cover is less dependent upon the training and skill of the upholstery cover installer, resulting in better quality control, better value for the consumer, and better margins for the manufacturer.

DETAILED DESCRIPTION

Figure 1A:
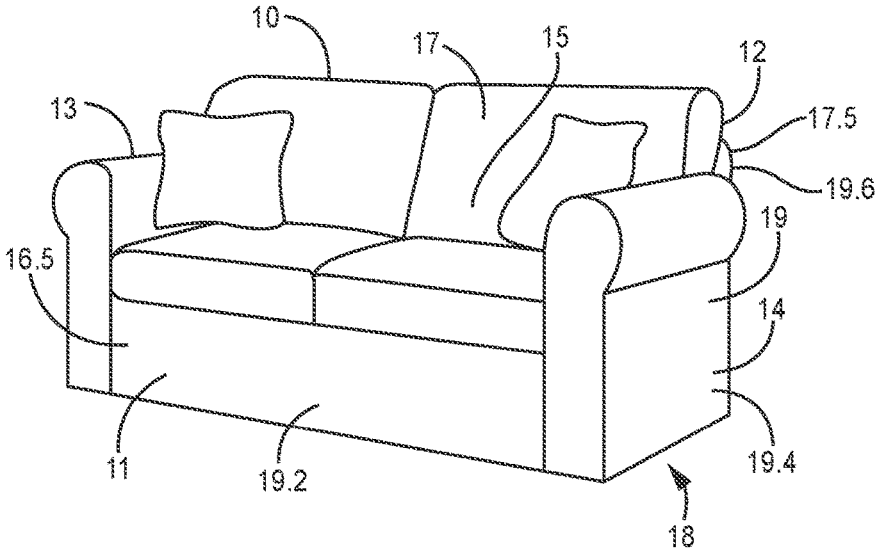
FIG. 1A is a representative view of an upholstered sofa according to an embodiment of the disclosure.
Figure 1C:
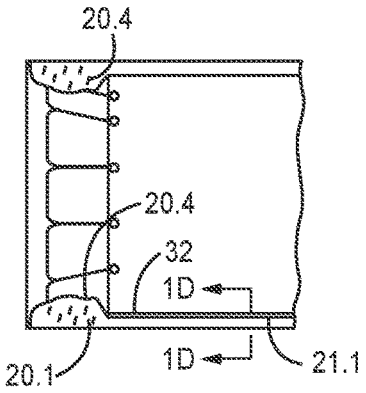
FIG. 1C is a bottom view of another embodiment of a sofa.
Figure 1B:
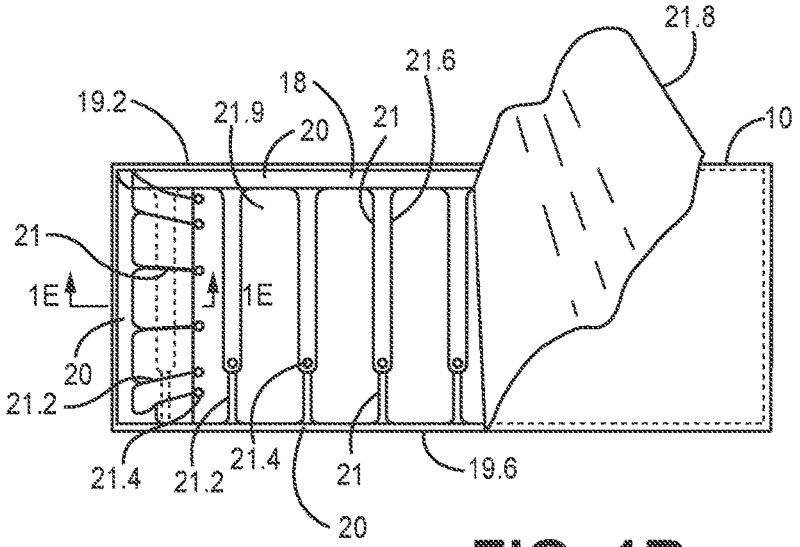
FIG. 1B is a bottom side view of the sofa of FIG. 1A with a portion of a dust cover removed.

Referring to FIGS. 1A and 1B, an upholstered sofa 10 is illustrated having a front side 11, a back side 12, a right side arm rest 13, and a left side arm rest 14. The sofa 10 comprises a seating area 15 defined by seat cushions 16 on a seat base 16.5, and back cushions 17 on a back rest 17.5. The sofa on all sides, except the bottom side 18 covered by upholstery 19 of formed of upholstery material 19.1 attaching to a sofa frame 22. The upholstery comprising a seat base cover 19.2, an arm rest cover 19.4, and a back rest cover 19.6, each having edge portions 20 positioned on the bottom side 18 of the sofa. The edge portions 20 having attachment means 21, such as elastic cords 21.2 with rigid connectors 21.4, generally non-elastic straps 21.6. The edge portion of the seat base cover may be connected to the edge portion 20 of the back rest cover 19.6 by way of the straps 21.6 hooked to elastic cords 21.2 with connectors 21.4. The straps may be sewn or otherwise attached at the edge portions 20. A dust cover 21.8 is stapled over the underneath opening 21.9 to cover all of the edge portions 20 and associated attachment means and connectors and generally to close the opening.

Figure 1E:
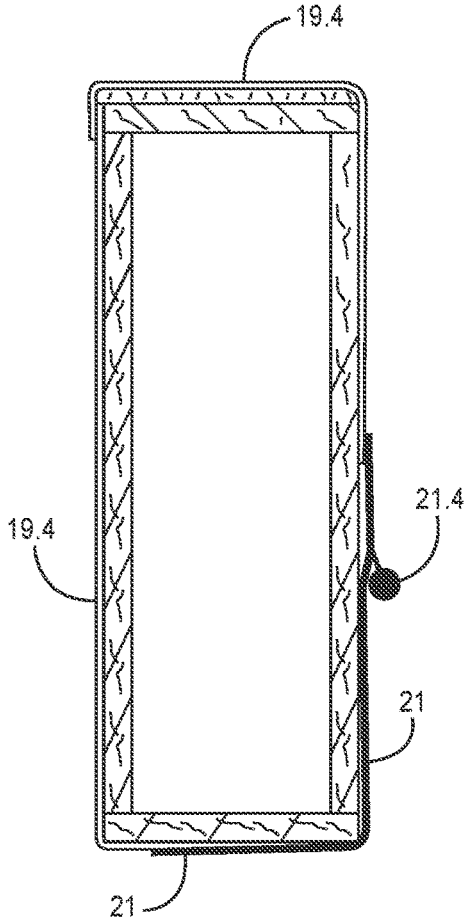
FIG. 1E is a cross sectional view taken at line 1E-1E of FIG. 1B.
Figure 1F:
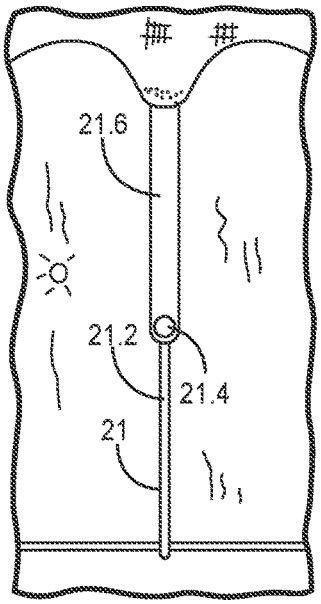
FIG. 1F is a detail side elevation view of the arm rest frame portion and connector of FIG. 1E.
Figure 1D:
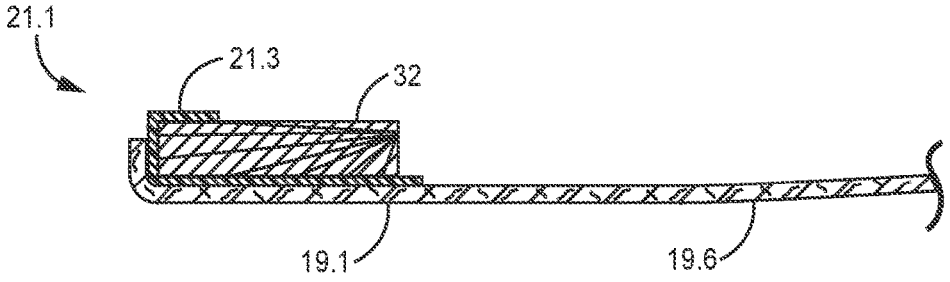
FIG. 1D is a cross sectional view taken at line 1D-1D of FIG. 1C.
Figure 2:
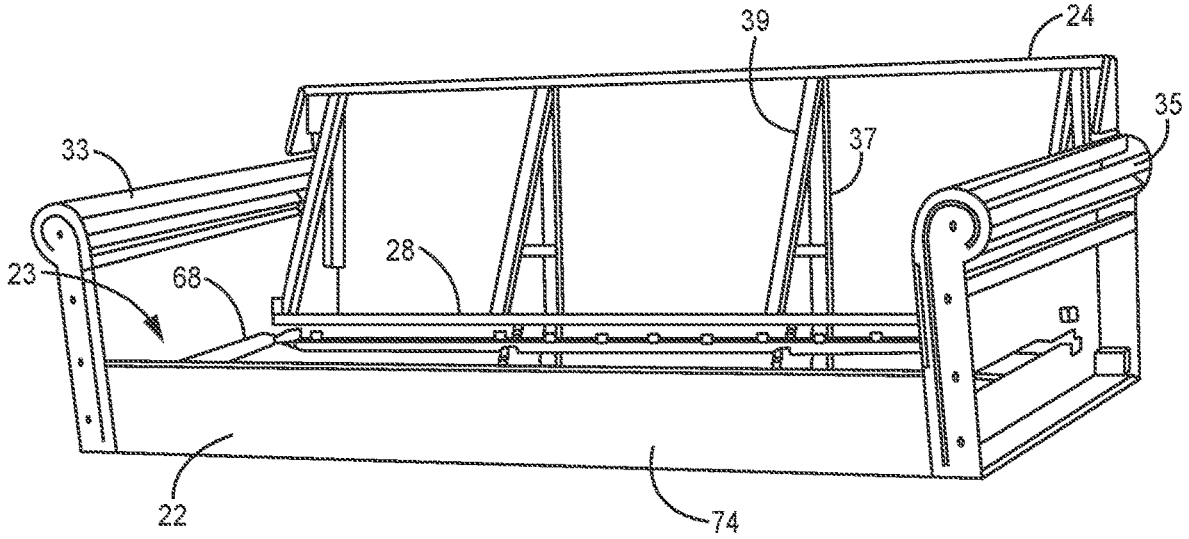
FIG. 2 is a representative front view of a wood frame according to an embodiment of the disclosure.
Figure 3:
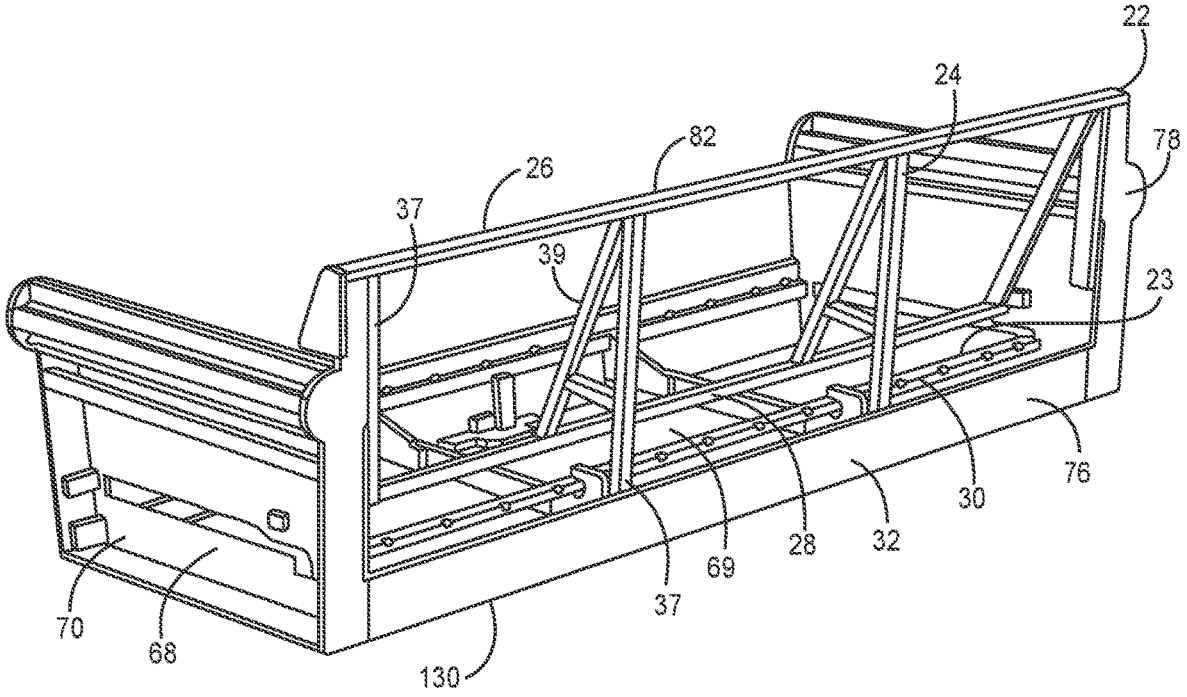
FIG. 3 is a representative back view of a wood frame according to an embodiment of the disclosure.
Figure 4:
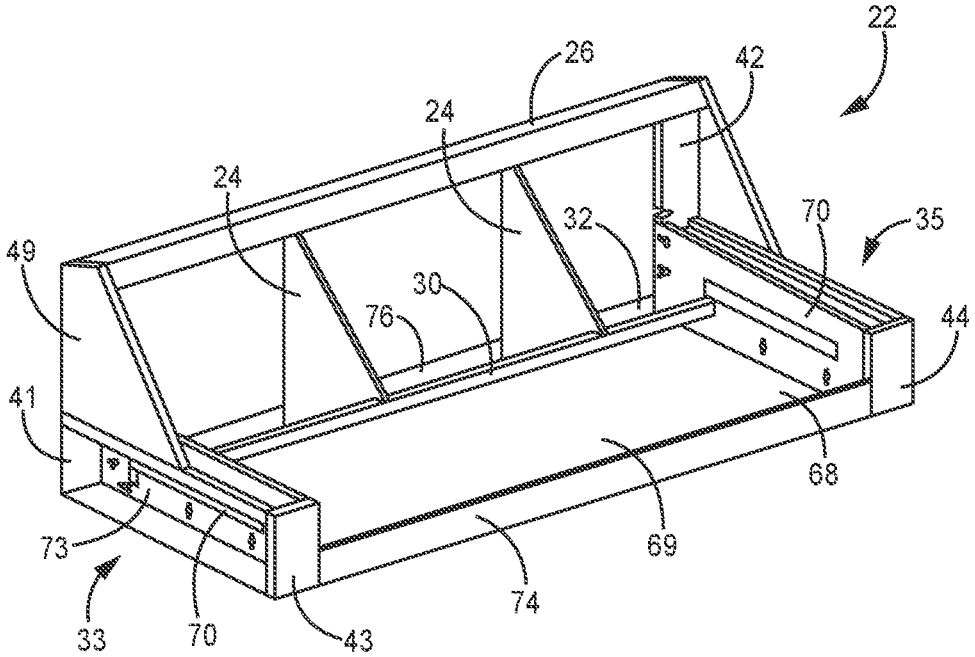
FIG. 4 is a representative front view of a wood frame according to an embodiment of the disclosure.

Referring to FIGS. 1C and 1D, an alternate upholstery attachment means 21.1 comprises a J-shaped polymer channel 21.3 is sewn to the upholstery material 19.1 and the channel is hooked or snapped onto the rear panel frame member 32. In addition to the J-shaped channel attaching the upholstery material to the sofa frame, another edge portion 20.1 of the backrest cover may be attached with staples 20.4.

Referring to FIGS. 1B, 1E, and 1F, the arm rest cover may have opposite edge portions of the upholstery material that are secured to each other through the tension provided by the elastic cord 21.2.

When used herein, "upholstery" and "upholstery material" includes fabric, leather, synthetic fabric, faux leather, microfiber, and other sheet material used for covering sofas and chairs.

Sofa Frames

As depicted in FIGS. 2-6, a wood sofa frame 22, according to an embodiment of the present disclosure, comprises a seat base frame portion 23 and an upright back rest frame portion 24 integral with the seat base frame portion 23, "integral" in that components are fixed together at the factory with permanent fasteners, such as glue, nails, or screws, and may have common frame members and they are not detachable from one another without damage. In embodiments, the wood sofa frame 22 can further comprise a pair of arm rest frame portions 33, 35 where the seat base frame portion 23 and back rest frame portion 24 are disposed between the arm rest frame portions 33, 35 and are integral to the arm rest frame portions 33, 35. The seat base frame portion 23 comprises a box frame portion 68 comprising a rectangular shape and having a left side 70, a right side 73, a front side 74, a back side 76, so that the box frame portion 68 defines an open interior space 69. The back rest frame portion 24 further comprises a back side 78 and a top 82 with a top rail 26. The back rest frame portion 24 is affixed to the back side 76 of the seat base frame portion 23. In embodiments, a wood sofa frame 22 further comprises a breast rail 28 attached at a lower portion of the back rest frame portion. In embodiments, a wood sofa frame 22 further comprises a spring rail 30 attached at a lower portion of the back rest frame portion. The back rest frame portion 24 further comprises a back side 78 and a top 82 with a top rail 26. The back rest frame portion 24 is affixed to the back side 76 of the seat base frame portion 23.

In embodiments, the sofa frame 22 can comprise wood or wood products, such as hardwood, engineered wood, oriented strand board (OSB), plywood, or particle board. "Wood" when used herein includes such wood products. "Substantially" when used herein means within 10% of a given quantity or value. Sofa frames 22 of varying configurations, including portions formed of polymers, metals, or alloys, are contemplated and sofa frames 22 of varying configurations are within the spirit and scope of this disclosure. In embodiments, arm rest frame portions 33, 35 can be formed of materials other than wood materials such as polymers by molding methods, such as blow molding (injection blow molding, extrusion blow molding, injection stretch blow molding).

Figure 5:
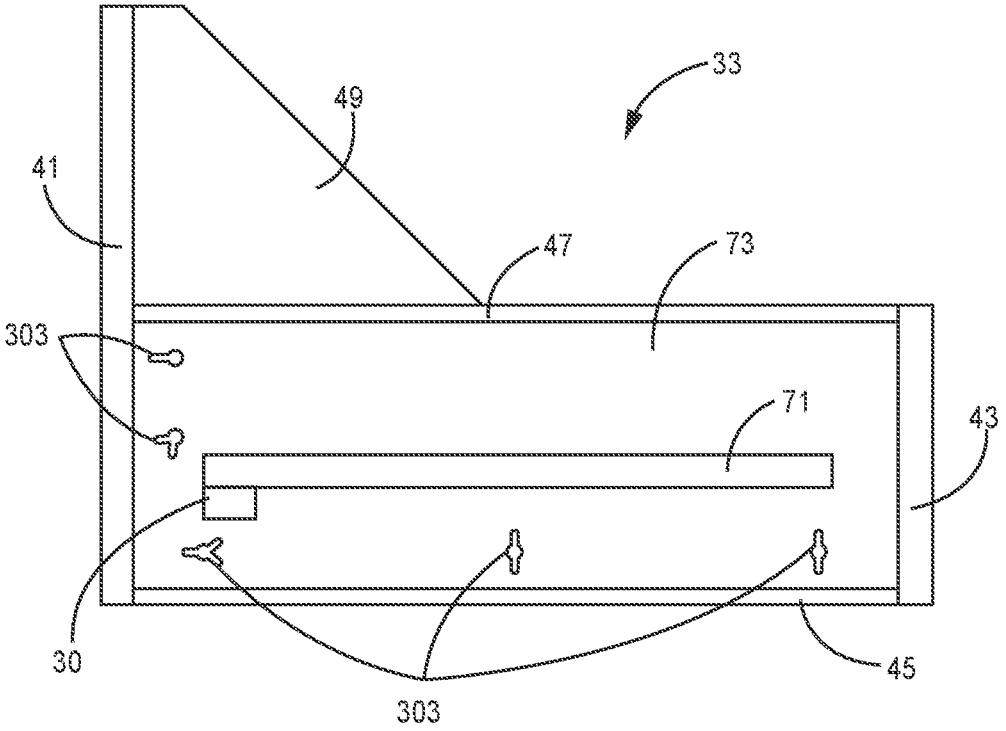
FIG. 5 is a side elevational view of a wood frame according to an embodiment of the disclosure.
Figure 6:
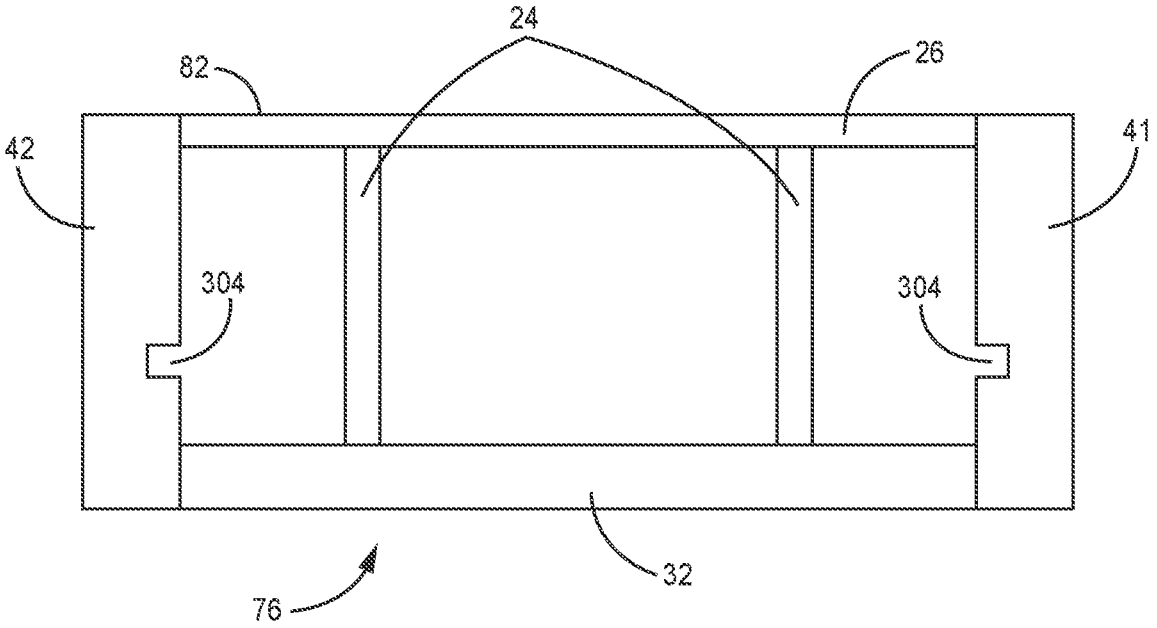
FIG. 6 is a back elevational view of a wood frame according to an embodiment of the disclosure.
Figure 7A:
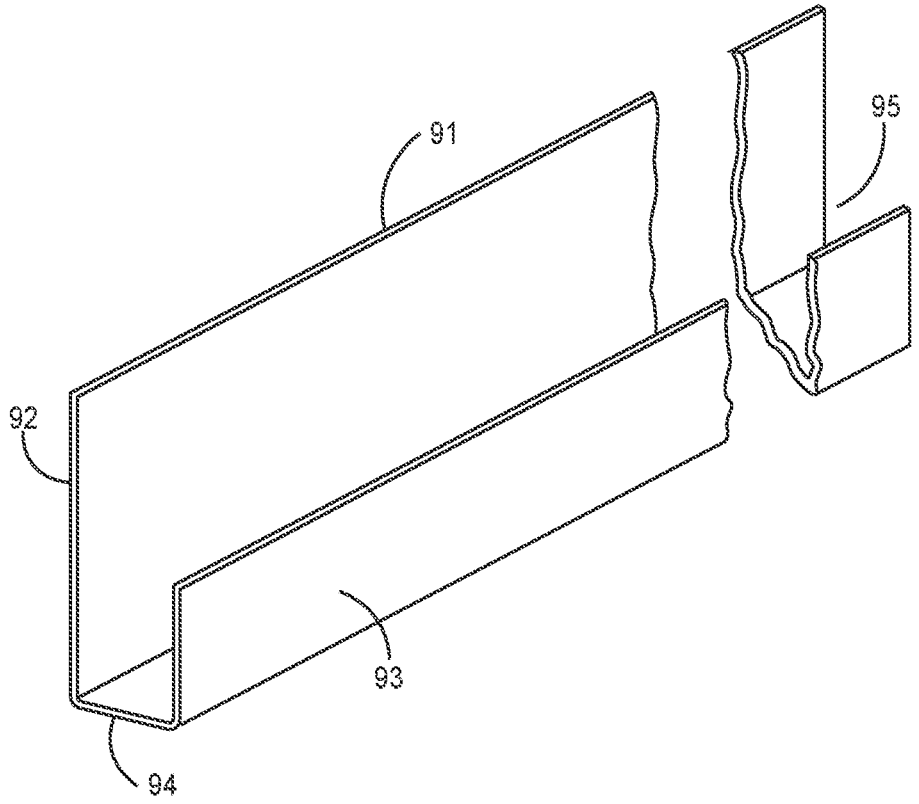
FIG. 7A is a representative perspective view of a J-shaped fastener strip according to an embodiment of the disclosure.
Figure 7B:
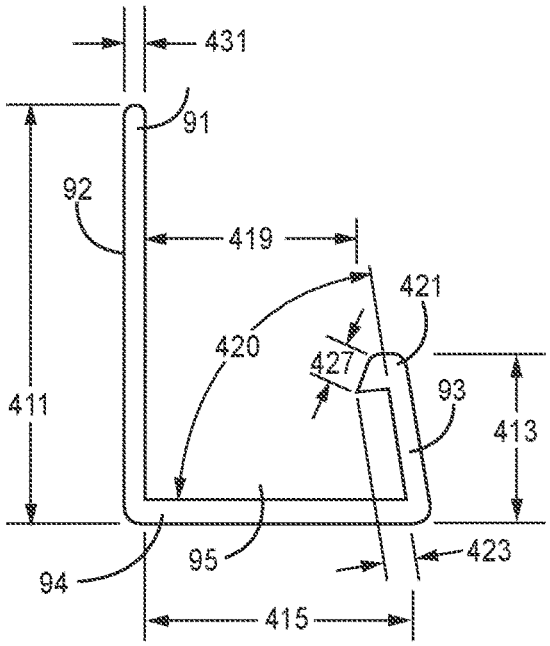
FIGS. 7B-7D are representative end views of J-shaped fastener strips according to embodiments of the disclosure.
Figure 7C:
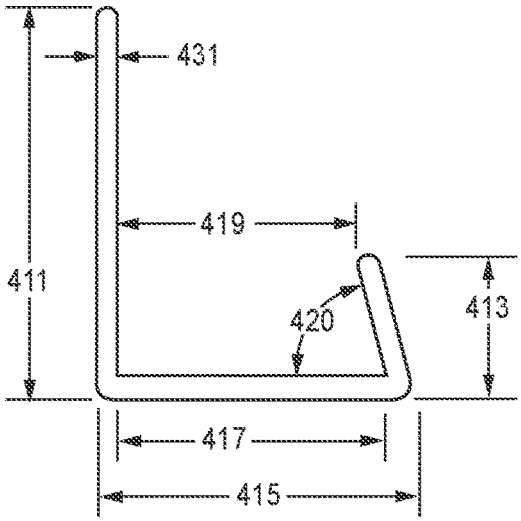
Figure 7D:
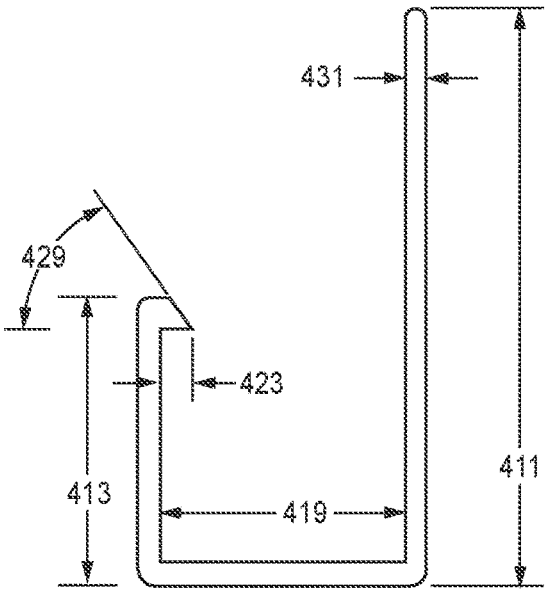

As depicted in FIG. 5, right arm rest 33 comprises a back post 41, a front post 43, a base 45, and a side 73. In some embodiments, right side 73 further comprises one or more anchor member receiving portions 303. In some embodiments, right side 73 supports a spring rail 30. In some embodiments, spring rail 30 is affixed to right side 73 using fixed fasteners such as glue, nails, screws, bolts, or the like. In some embodiments, right side 73 supports a breast rail. In some embodiments, right side 73 has an aperture 71 capable allowing portions of a seat deck assembly to pass through. In some embodiments, right arm rest 33 comprises one or more cross bar members 47. In some embodiments, back post 41, front post 43, and base 45 comprise one or more anchor member receiving portions 303 or notches 304 or other anchor member receiving structures to which the elastic fasteners 101, described below, can be operably coupled or attached to. In some embodiments, right arm rest 33 comprises a wing 49.

A left arm rest 35 comprises a back post 42, a front post 44, a base 46, and a side 70. In some embodiments, left arm rest 35 is a mirror image of right arm rest 33. In some embodiments, left side 70 further comprises one or more anchor member receiving portions 303 or notches 304 or other anchor member structures to which the cords, described below, can be operably coupled or attached to. In some embodiments, left side 70 supports a spring rail 30. In some embodiments, spring rail 30 is affixed to left side 70 using fixed fasteners such as glue, nails, screws, bolts, or the like. In some embodiments, left side 70 supports a breast rail. In some embodiments, left side 70 has an aperture 72 capable allowing portions of a seat deck assembly to pass through. In some embodiments, left arm rest 35 comprises one or more cross bar members 48. In some embodiments, back post 42, front post 44, and base 46 comprise one or more anchor member receiving portions 303 or notches 304. In some embodiments, left arm rest 35 comprises a wing 49.

Upholstery Fastening Means

An upholstered sofa according to embodiments of this disclosure may use various combinations of fastening means to secure upholstery components to the wood sofa frame. Some fastening means may be well known to those skilled in the art. For example, stapling portions of an upholstery kit to a wood frame may be understood by skilled artisans.

Fastener Strips

FIGS. 7A-7D illustrate embodiments of a J-shaped fastener strip 91. Fastener strip 91 has a long leg 92, a short leg 93, and a base leg 94 defining a channel 95 adapted to engage with the wood frame members of the wood sofa frame 22. Fastener strip 91 is at minimum 12 inches in length in embodiments and securely captures a frame member of the wood sofa frame 22. In embodiments, fastener strip 91 is has a long leg length 411 between 20 and 40 millimeters. Fastener strip 91 may have a short leg height 413 between 5 and 25 millimeters. Fastener strip 91 may have an exterior base leg length 415 between 15 and 20 millimeters and an interior base leg length 417 between 10 and 20 millimeters. In embodiments, a channel angle 420 between the short leg 93 and base leg 94 may be between 60 and 90 degrees. In embodiments, fastener strip 91 has an opening width 419 between 10 and 20 millimeters. In embodiments, an end of fastener strip 91 may have a barb 421. Barb 421 may have a barb length 423 between 1 and 4 millimeters. Barb 421 may have a sloped face 425 with a sloped face length 427 between 1 and 4 millimeters. In embodiments, sloped face 425 may form a face angle 429 between 30 and 60 degrees with respect to a plane parallel to base leg 94. Fastener strip 91 may have a thickness 431 between 1 and 2 millimeters.

Figure 8A:
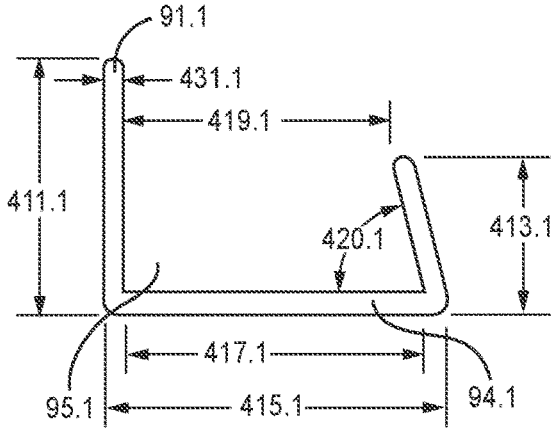
FIGS. 8A-8C are representative end views of U-shaped fastener strips according to embodiments of the disclosure.
Figure 8B:
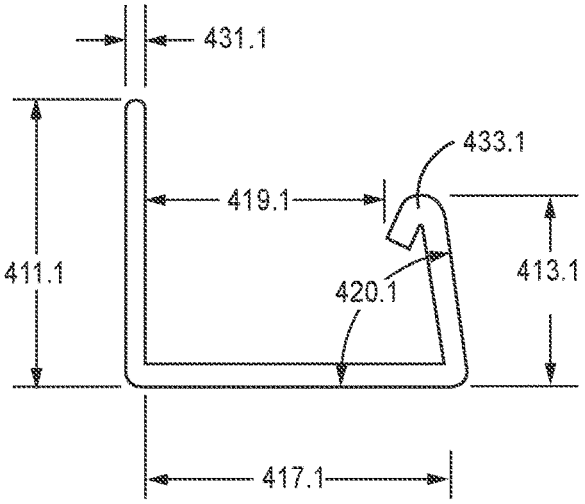
Figure 8C:
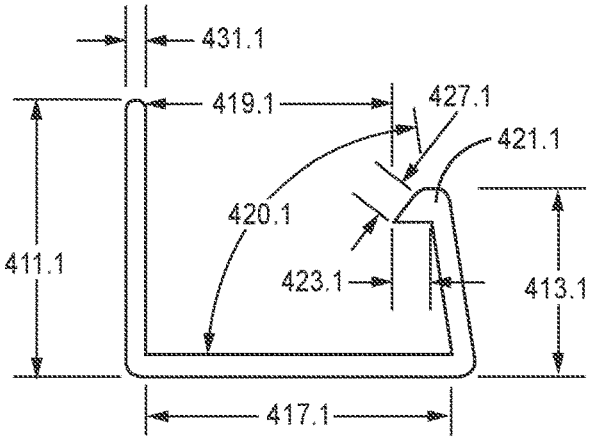

In other embodiments, FIGS. 8A-8C illustrate a U-shaped fastener strip 91.1. Fastener strip 91.1 has a long leg 92.1, a short leg 93.1, and a base leg 94.1 defining a channel 95.1 adapted to engage with the wood frame members of the wood sofa frame 22. Fastener strip 91.1 is at minimum 12 inches in length in embodiments and securely captures a frame member of the wood sofa frame 22. In embodiments, fastener strip 91.1 is has a long leg length 411.1 between 8 and 20 millimeters. Fastener strip 91.1 may have a short leg height 413.1 between 8 and 20 millimeters. Fastener strip 91.1 may have an exterior base leg length 415.1 between 15 and 30 millimeters and an interior base leg length 417.1 between 15 and 30 millimeters. In embodiments, a channel angle 420.1 between the short leg 93.1 and base leg 94.1 may be between 60 and 90 degrees. In embodiments, fastener strip 91.1 has an opening width 419.1 between 10 and 25 millimeters. In embodiments, an end of fastener strip 91.1 may have a barb 421.1. Barb 421.1 may have a barb length 423.1 between 1 and 4 millimeters. Barb 421.1 may have a sloped face 425.1 with a sloped face length 427.1 between 1 and 4 millimeters. In embodiments, an end of fastener strip 91.1 may have a hooked end 433.1 Fastener strip 91.1 may have a thickness 431.1 between 1 and 2 millimeters.

A fastener strip 91 may comprise a unitary homogenous and resilient material capable of flexing open to be placed around a member of the furniture frame 22 under the force exerted by an installer. For example, the fastener strip 91 may comprise a resilient polymer material. When the channel 95 engages the wood sofa frame 22, at the three legs 92, 93, 94 of the fastener strip 91 extend around two corners and three sides of the wood frame member. Surprisingly, it was determined through experimentation and measurement that a fastener strip 91 is less likely to pull off the wood frame member when the fastener strip 91 is aligned such that short leg 93 is placed on the wood frame member in the same direction as the tension force as applied by the upholstery cover. The fastener strip 91 is permanently affixed to the form fit upholstery cover at an edge portion of the cover by stitching, sewing, gluing, or other means known in the art. The fastener strip 91 may be affixed to the form fit upholstery cover along a single side. In one embodiment, the fastener strip 91 is affixed to the form fit upholstery cover by a continuous longitudinal stitch substantially along the center of the channel 95, thereby affixing the bottom side 94 to the form fit upholstery cover. In another embodiment, the fastener strip 91 is affixed to the form fit upholstery cover by a continuous longitudinal stitch through the long leg 92 and running parallel to channel 95, thereby affixing the left side 92 of the fastener strip 91 to the form fit upholstery cover. In all of the embodiments herein staples or other fasteners may be used to fix the fastener stripping in place.

In embodiments, the channel 95 may be formed of other materials other than a polymer and may be more or less resilient. The channeled fastener strip may be attached to the upholstery by other means than stitching, for example staples, for example adhesives, for example, a molten polymer, or other means. Although the channeled fastener strips are illustrated as linear, in embodiments they may be curved to follow, for example, the curvature at a corner of a wood sofa frame. In embodiments the form fit upholstery cover may be applicable to a single seat upholstered chair.

Elastic Fasteners

Figure 9C:
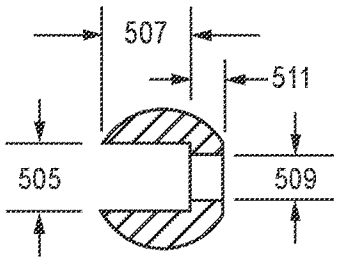
FIG. 9C is a cross-sectional view of the ball anchor member as taken along the sectional line shown in FIG. 9B according to an embodiment of the disclosure.
Figure 9B:
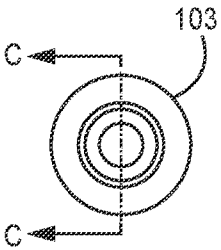
FIG. 9B is an end view of a ball anchor member according to an embodiment of the disclosure.
Figure 9E:
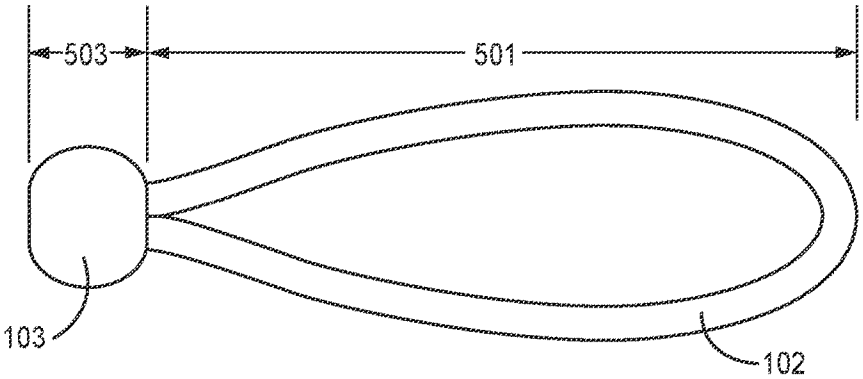
FIG. 9E is a side view of a ball elastic fastener according to embodiments of the disclosure.
Figure 9A:
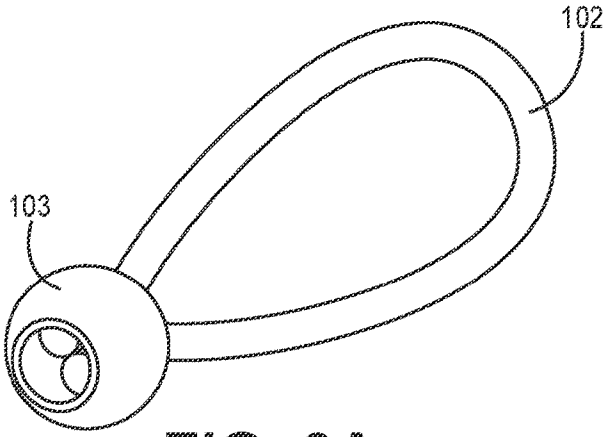
FIG. 9A is a perspective view of a ball elastic fastener according to an embodiment of the disclosure.
Figure 9D:
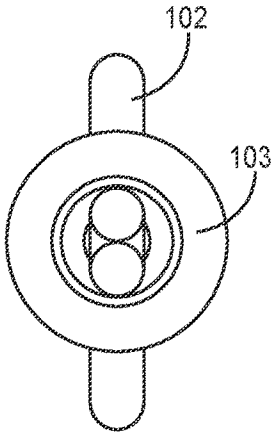
FIG. 9D is an end view of a ball elastic fastener according to embodiments of the disclosure.

Referring to FIGS. 9A-9H, a fastener 101 according to embodiments of the present disclosure is depicted comprising an elastic cord 102 and an anchor member 103. FIG. 9A illustrates a ball elastic fastener 101 according to an embodiment. In another embodiment, elastic fastener 101 has an elastic cord 102 and a ball 103.1 adapted to engage with anchor member receiving portions 303 or notches 304 cut into frame members of the sofa frame 22. An elastic cord 102 may comprise a material capable of stretching under the force exerted by an installer and returning to its original length when that force is removed. For example, the elastic cord 102 may comprise a rubber material or a thermoplastic elastomer. In another embodiment, the elastic cord 102 may comprise one or more elastic cords forming a core and bound with a fabric covering. In embodiments, the elastic cord 102 may be a bungee cord. Exemplary performance characteristics of elastic cords are illustrated in the following table

| Dia. Metric/Inches | 5/32" | 3/16" | 1/4" | 5/16" | 3/8" | 13/32" | 1/2" |
|---|---|---|---|---|---|---|---|
| Tensile Properties, Load: | | | | | | | |
| @ 50% Elongation: Pounds | 1.75 | 3.50 | 6.25 | 6.00 | 7.75 | 9.50 | 11.00 |
| @ 75% Elongation: Pounds | 2.25 | 4.50 | 8.25 | 7.75 | 9.25 | 12.00 | 13.75 |
| @ 100% Elongation: Pounds | 3.25 | 6.25 | 12.00 | 10.00 | 11.25 | 14.75 | 17.50 |
| @ 125% Elongation: Pounds | 9.50 | 18.00 | 33.50 | 15.50 | 14.00 | 20.75 | 23.25 |
| Breaking Strength, Min. Pounds | 61 | 132 | 185 | 237 | 241 | 354 | 555 |
| Ultimate Elongation, % Minimum | 160% | 175% | 185% | 210% | 210% | 210% | 240% |

Ref: https://performancehobbies.com/tibungee.htm

In embodiments of the invention, elastic cords with anchor members may have performance characteristics within 40% of the parameters described above. In embodiments elastic cords may have an elongation of 50% of the length of the cord under tension of between 2 pounds and 15 pounds. In embodiments elastic cords may have an elongation of 50% of the length of the cord under tension of between 5 pounds and 25 pounds. In embodiments elastic cords may have an elongation of 50% of the length of the cord under tension of between 10 pounds and 25 pounds.

The elastic cord 102 may be looped such that one end of the elastic fastener 101 connects to an edge portion and an opposite end extends through an anchor member capable of secure engagement with another corresponding anchor member receiving portions of the sofa frame 22. In an unelongated state, the elastic cord 102 may have an elastic cord length 501 between 40 and 120 millimeters from an edge of the ball 103.1 to an end of elastic cord 102. In embodiments, the anchor member 103 of the elastic fastener 101 is a ball 103.1. In embodiments, the ball 103.1 may have a depth 503 between 10 and 25 millimeters. The ball 103.1 contains one or more apertures allowing both the elastic cord 102 to pass through the ball 103.1. In embodiments, the ball 103.1 may have a first opening with a width 505 between 5 and 20 millimeters and a depth 507 between 5 and 20 millimeters. In embodiments, the ball 103.1 may have a second opening abutting the first opening, where the second opening has a width 509 between 5 and 15 millimeters and a depth 511 between 1 and 10 millimeters. The two ends of the elastic cord 102 extending through the one or more openings of ball 103.1 are then bound together such that the ball 103.1 is restrained by the elastic cord 102 and the opposite end of the elastic cord 102 forms a loop. In embodiments, the two ends of the elastic cord 102 may be tied together in a knot. In other embodiments, the two ends of the elastic cord 102 may be bound together using fastening means such as a metal clip.

Figure 9F:
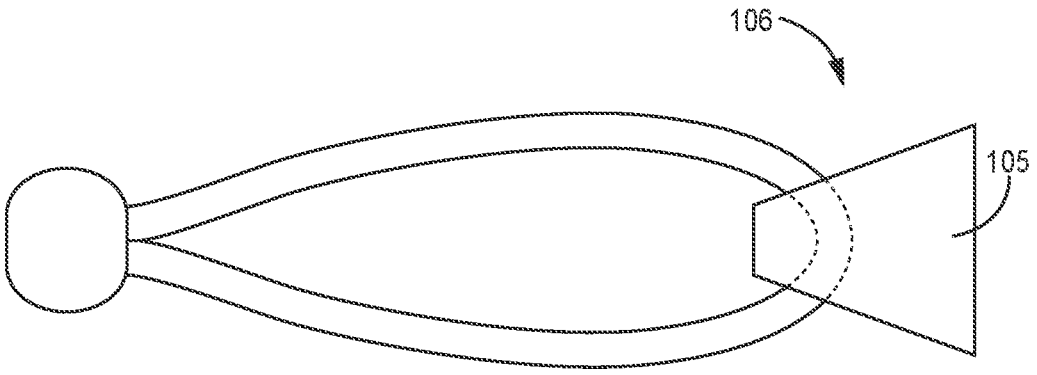
FIG. 9F is a side view of a ball elastic fastener and fabric loop according to an embodiment of the disclosure.
Figure 9G:
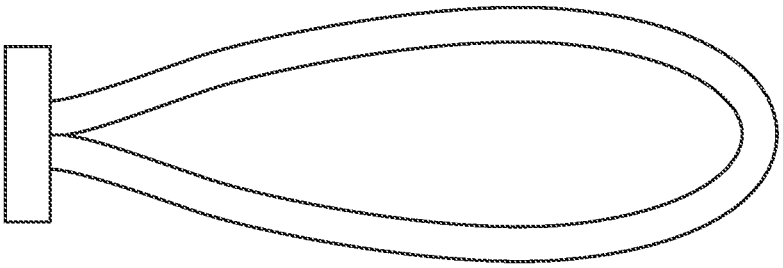
FIG. 9G is a side view of a T-bar elastic fastener according to an embodiment of the disclosure.
Figure 9H:
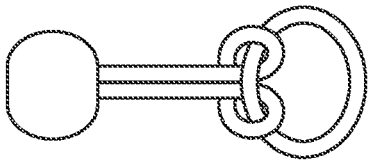
FIG. 9H is a view of a ball elastic fastener secured to an eyelet according to an embodiment of the disclosure.

FIG. 9G illustrates a T-bar elastic fastener 101.2 where the anchor member is a T-bar 103.2. The T-bar 103.2 can be turned or angled, thereby creating a narrow profile, such that the T-bar 103.2 can pass through anchor member receiving portions such as holes 303 or notches 304 in the sofa frame 22. Once the T-bar 103.2 has passed through an anchor member receiving portion, the T-bar 103.2 can be turned or angled, thereby creating a wide profile, such that when the T-bar 103.2 is pulled against the frame member of the sofa frame 22, the T-bar 103.2 is unable to be withdrawn back through the anchor member receiving portion.

The elastic fastener 101 can be permanently affixed to the form fit upholstery cover at an edge portion of the cover. In embodiments, as depicted in FIG. 9F, the elastic fastener 101 may be affixed to the form fit upholstery cover by a piece of fabric 105 forming a loop support member 106 and allowing the loop formed by the elastic cord 102 of the elastic fastener 101 to pass therethrough. The piece of fabric 105 may then be permanently affixed to the form fit upholstery cover by stitching, sewing, gluing, or other means known in the art. The elastic fastener 101 may be affixed to the form fit upholstery cover along a single side. In another embodiment, as depicted in FIG. 5D, the elastic fastener 101 may be affixed to an eyelet or opening at an edge portion of the cover. The loop end of the elastic fastener 101 may pass through an eyelet or opening at an edge portion of the cover such that the loop end extends outward on one side of the cover and the anchor member 103 remains on the opposite of the cover. The anchor member 103 of the elastic fastener 101 may then be pulled around the outside of the edge portion of the cover and through the loop end of the elastic fastener 101. When the anchor member fastening portion 103 is fully pulled through the loop end of the elastic fastener 101, the elastic cord 102 is pulled taught, thereby securing the elastic fastener 101 firmly to the edge portion of the cover. In embodiments, a rod or other rigid material, such as an elongate polymer strip, may be affixed to an edge portion of the cover, thereby ensuring the edge portion of the cover does not bunch up in any one area along the sofa frame 22. In embodiments, the edge portion of the cover may folded around the rod or other rigid material and stitched, thereby securing the rod or other rigid material in place. In embodiments, the edge portion of the cover may be folded back and stitched into place, defining a pocket into which a rod or other rigid material may be slid. In embodiments, the elastic fastener 101 may be secured about the rod or other rigid material.

Upholstery Kits

Figure 10:
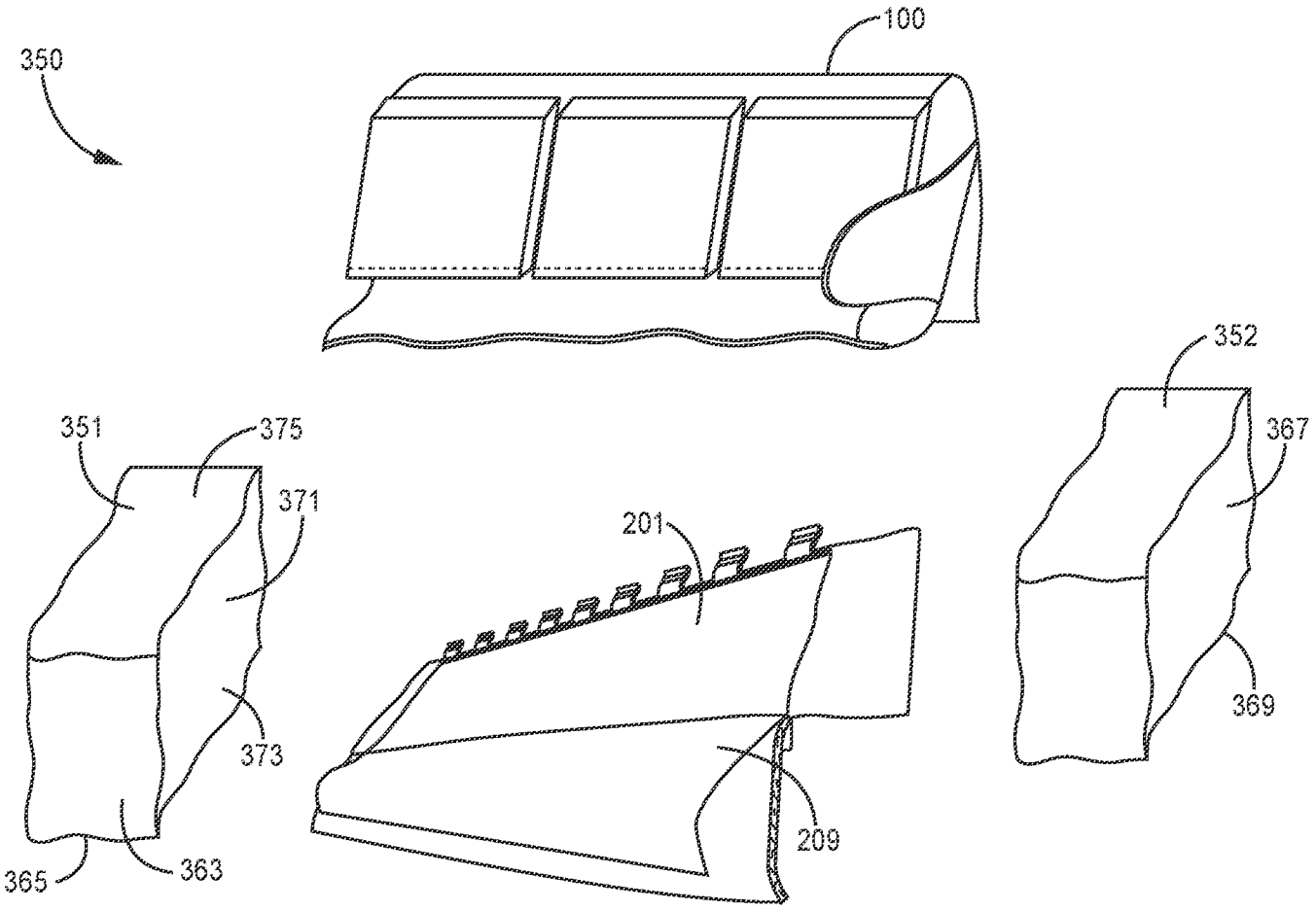
FIG. 10 is a perspective view of an upholstery kit according to an embodiment of the disclosure.

An upholstery kit 350 may comprise several components, as illustrated in FIG. 10. According to embodiments, an upholstery kit 350 may include a form fit upholstery cover 100, a right arm rest cover 351, a left arm rest cover 353, a front material panel 209, and a seat deck assembly 201. In embodiments, the front material panel 209 may be attached to the seat deck assembly 201 before it is secured to the sofa frame 22. For example, the front material panel 209 may be sewn to a portion of the seat deck assembly 201.

An arm rest cover 351, 353 may have a forward material panel 363 having a bottom edge portion 365, an outside material panel 367 having a bottom edge portion 369, an inward material panel 371 having a bottom edge portion 373 and a top material panel 375. The arm rest cover assembles onto a right or left arm rest frame portions 33, 35 of a wood sofa frame 22, where the wood sofa frame 22 is the structural base for a sofa, love seat, chair, or similar item of furniture. The arm rest cover 351, 353, according to embodiments, can be positioned over the right or left arm rest frame portions 33, 35 so that the right or left arm rest frame portions 33, 35 can be fully inserted into the arm rest cover 351, 353 so that the arm rest cover 351, 353 envelopes the right or left arm rest frame portions 33, 35. According to some embodiments, the forward material panel 363, outside material panel 367, inward material panel 371, and top material panel 375 may be comprised of a continuous piece of fabric. In other embodiments, the forward material panel 363, outside material panel 367, inward material panel 371, and top material panel 375 may be sewn or stitched together. In another embodiment, the outside material panel 367 may be comprised of multiple pieces of fabric sewn together along a common edge. In another embodiment, the top material panel 375 may be comprised of multiple pieces of fabric sewn together along a common edge. In another embodiment, a back material panel (not shown) may be comprised of multiple pieces of fabric sewn together along a common edge. In embodiments, one or more tabs, not shown, capable of receiving an anchor member may be stitched to an interior surface of the arm rest cover 351, 353.

Figure 11:
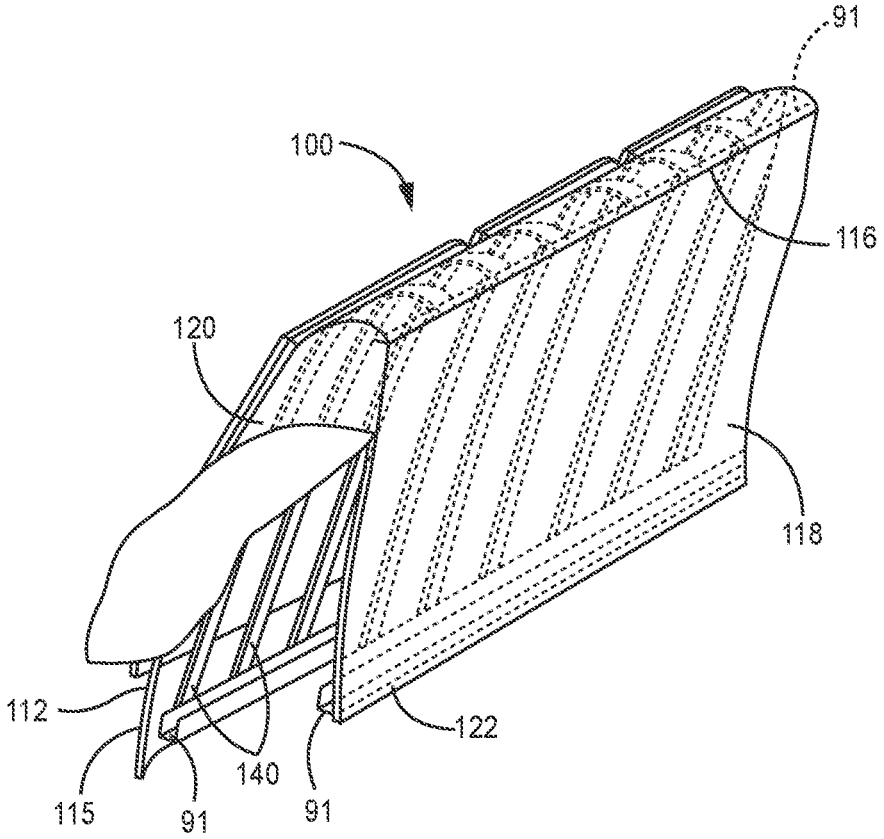
FIG. 11 is a perspective view of another form fit upholstery cover with fastening strips.
Figure 12:
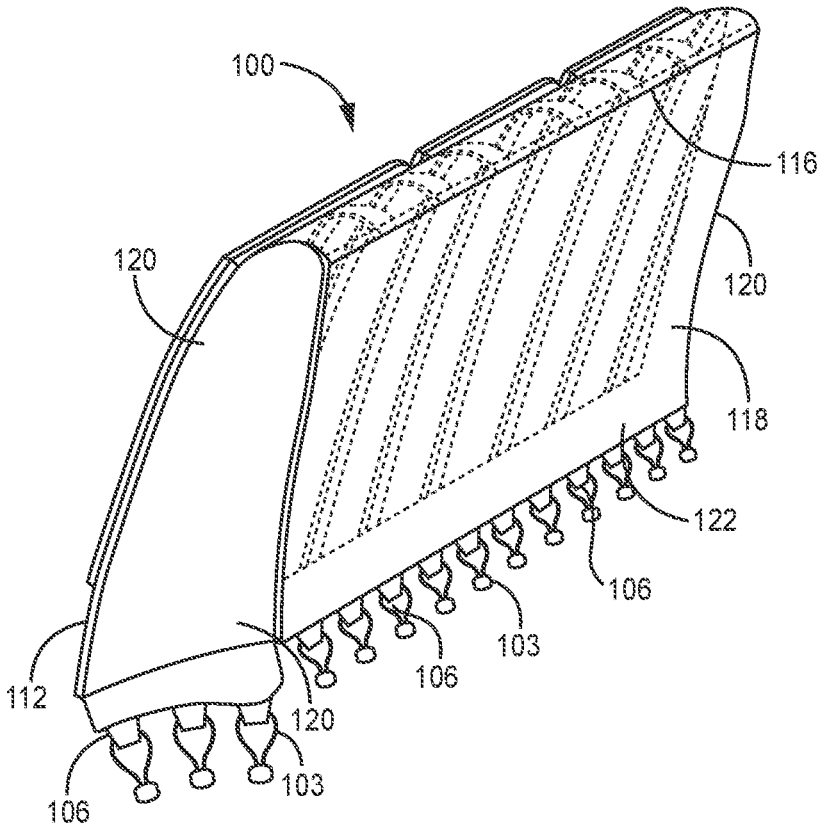
FIG. 12 is a perspective view of another form fit upholstery cover with elastic fasteners.
Figure 13:
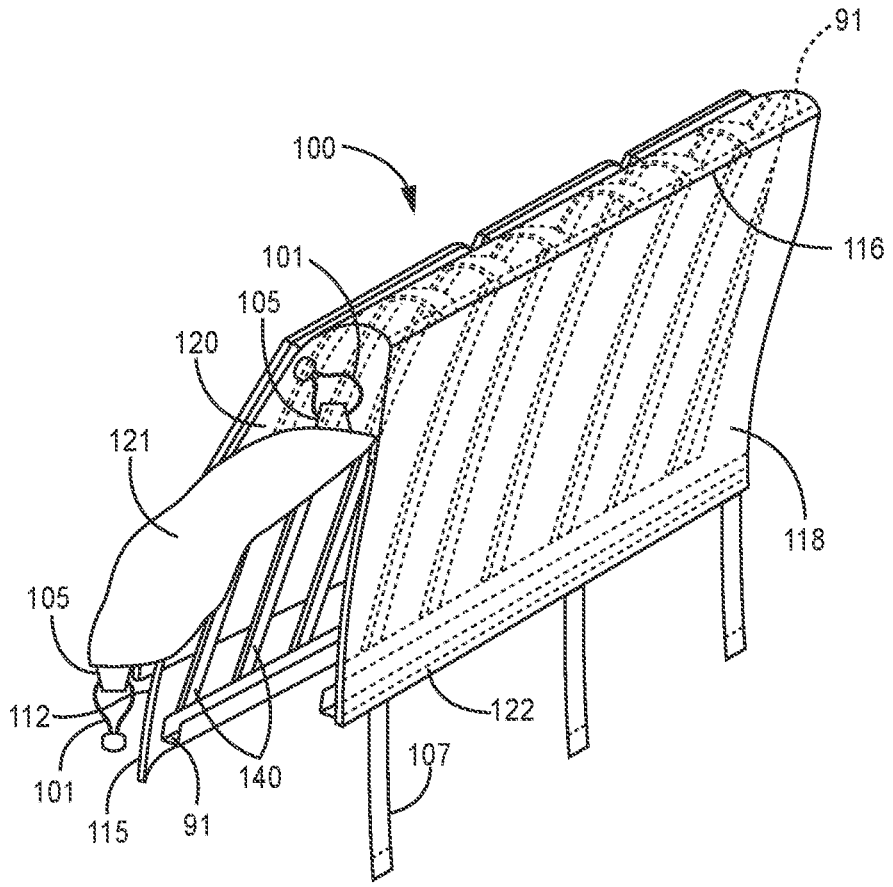
FIG. 13 is a perspective view of another form fit upholstery cover with fastening strips, elastic fasteners, and pulls.

Referring to FIGS. 11-13 FIG. 11 illustrates a form fit upholstery cover 100 having a forward material panel 112 having a bottom edge portion 115, a top edge portion 116, a back material panel 118 having a bottom edge portion 114 and side material panels 120. The form fit upholstery cover 100 assembles onto back rest frame portion 24 of a wood sofa frame 22, where the wood sofa frame 22 is the structural base for a sofa, love seat, chair, or similar item of furniture. In some embodiments, the side material panels 20 conform to the right and left arm rest frame portions 33, 35. In some embodiments, upholstery covers for the arms may be separate from the form fit upholstery cover 100 for the back. The form fit upholstery cover 100, according to embodiments, can be positioned over the back rest frame portion 24 so that the back rest frame portion 24 can be fully inserted into the form fit upholstery cover 10 so that the form fit upholstery cover 10 envelopes the back rest frame portion 24. According to some embodiments, the first material panel 112, top edge 116, back material panel 118, and side material panels 120 may be comprised of a continuous piece of fabric. In other embodiments, the first material panel 112, top edge 116, back material panel 118, and side material panels 120 may be sewn or stitched together. In another embodiment, the first material panel 112 may be comprised of multiple pieces of fabric sewn together along a common edge. In another embodiment, the top panel 116 may be comprised of multiple pieces of fabric sewn together along a common edge. In another embodiment, the back material panel 118 may be comprised of multiple pieces of fabric sewn together along a common edge.

Referring to FIG. 11, in embodiments, one or more fastener strips 91 are affixed to the first material panel 112 near the bottom edge portion 115 such that the channel 95 is substantially parallel to and is capable of rigidly engaging the breast rail 28 when the form fit upholstery cover 100 is disposed onto the furniture frame 22. In some embodiments, cardboard may be disposed between the fastener strips 91 and the first material panel 112. In some embodiments, where more than one fastener strips 91 are used along a common edge portion of the first material panel 112, cardboard may be disposed between the fastener strips 91 to provide additional rigidity along the edge portion of the first material panel 112. In some embodiments, fastener stripping 91 extends substantially along the bottom edge portion 115. In some embodiments, one or more fastener strips 91 are affixed to the back material panel 118 along the bottom edge portion 122 such that the channel 95 is substantially parallel to and is capable of rigidly engaging the back panel frame member 32 when the form fit upholstery cover 100 is disposed onto the wood sofa frame 22. In some embodiments, one or more fastener strips 91 are affixed to the top edge 116 such that the channel 95 is substantially parallel to and is capable of rigidly engaging the top rail 26 when the form fit upholstery cover 100 is disposed onto the furniture frame 22. In some embodiments, an additional piece of fabric may be disposed between the top edge 116 and the fastener strip 91 such that the fastener strip 91 is fixedly attached to the additional piece fabric. In some embodiments, fastener stripping 91 extends substantially along the top edge 116.

Referring to FIG. 12, in embodiments, one or more elastic fasteners 101 are attached to the back material panel 118 along the bottom edge portion 122 using intermediate loop support members 106, which may be formed of fabric pieces 105. In some embodiments, as depicted in FIG. 13, one or more pulls 107 are stitched or otherwise affixed to the edge portion of back material panel 118. An end of the pull 107 may be folded back and stitched, thereby creating a tab at the end of the pull 107 capable of receiving an anchor member. FIGS. 11-13 are offered by way of illustration only. Additional embodiments wherein a form fit upholstery cover 100 has different combinations of fastener strips 91, elastic fasteners 101, and pulls 107. See U.S. Pat. No. 10,034,554, owned by the owner of this invention. Said patent is incorporated by reference herein for all purposes.

Figure 14:
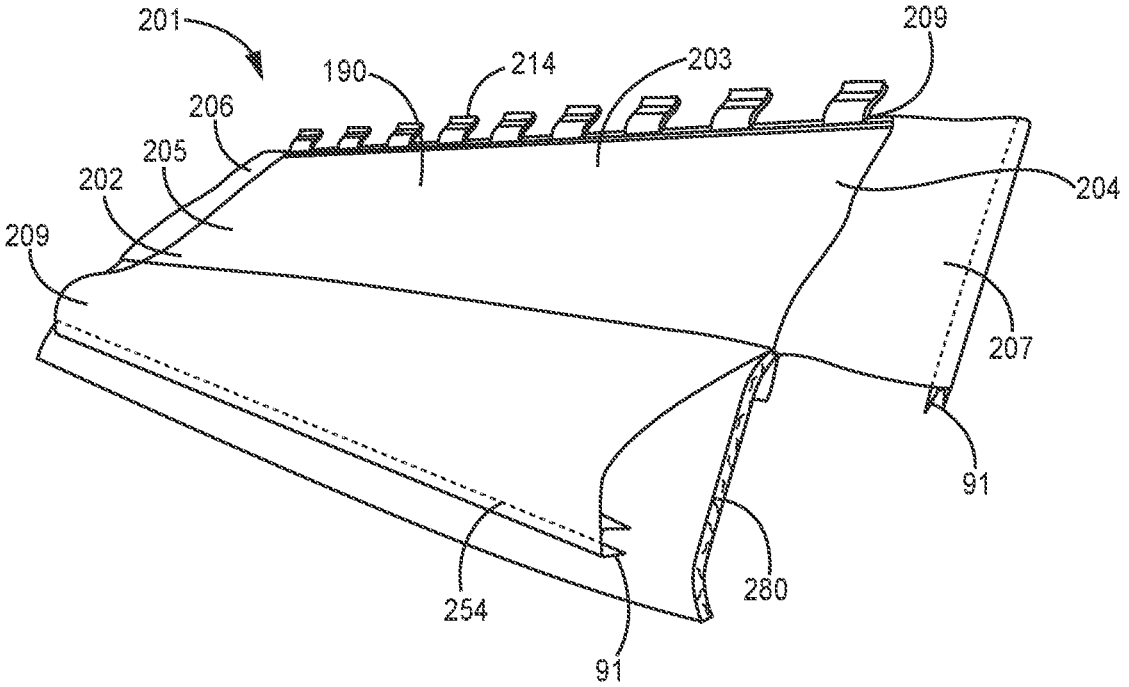
FIG. 14 is a seat deck assembly with upholstery in accord with embodiments.
Figure 15:
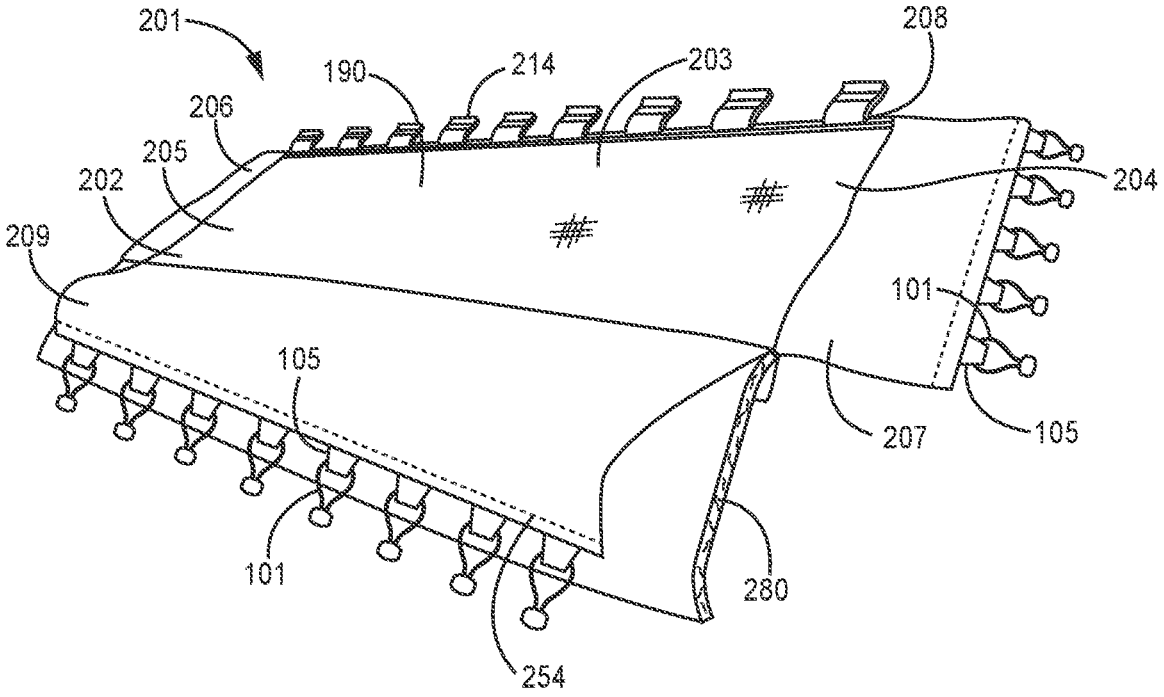
FIG. 15 is another seat deck assembly with upholstery in accord with embodiments.
Figure 16A:
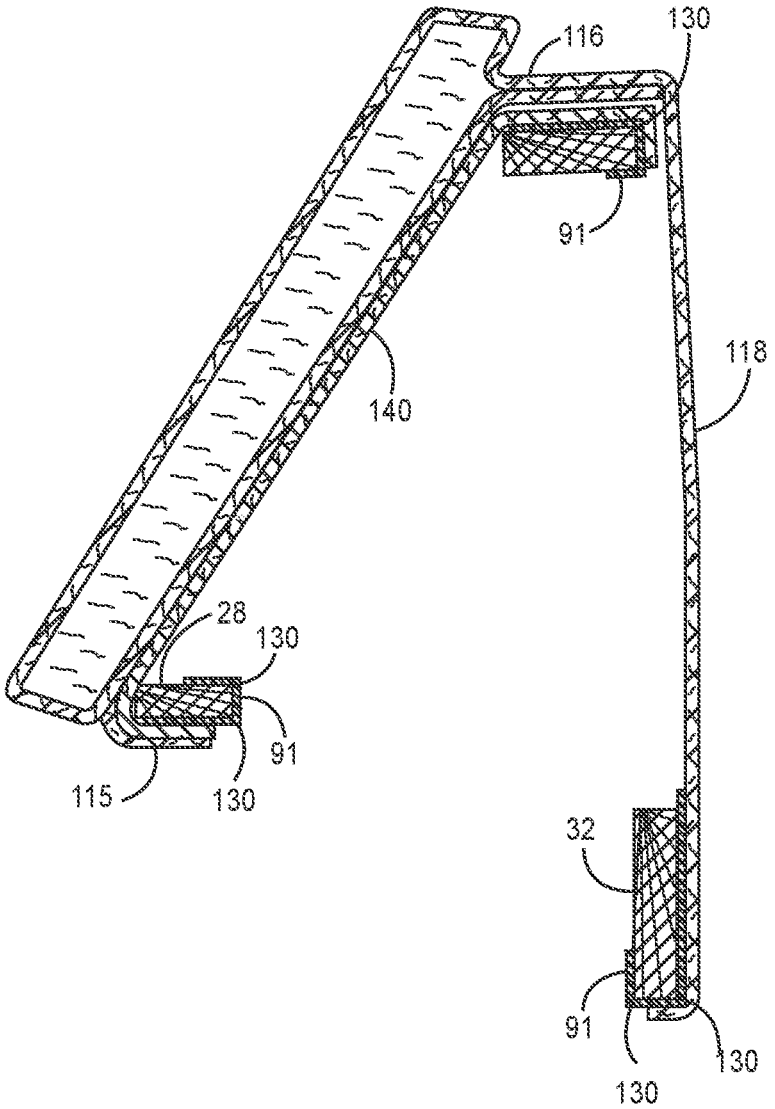
FIG. 16A-16E are cross sectional views of upholstery covers attached to a sofa frame according to various embodiments of the disclosure.
Figure 16D:
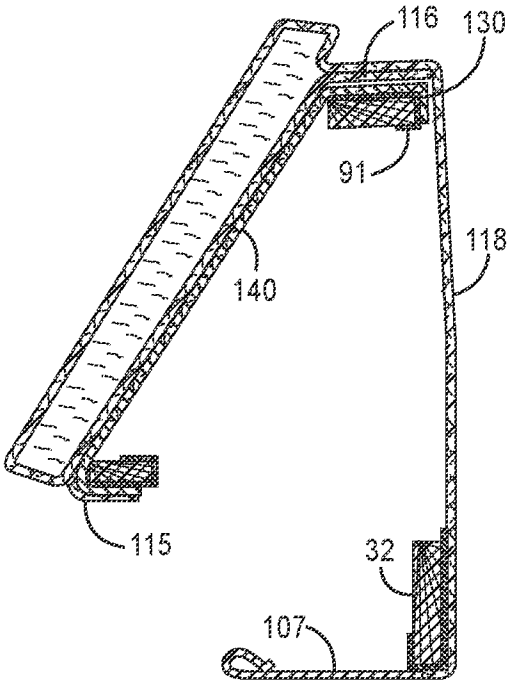
Figure 16C:
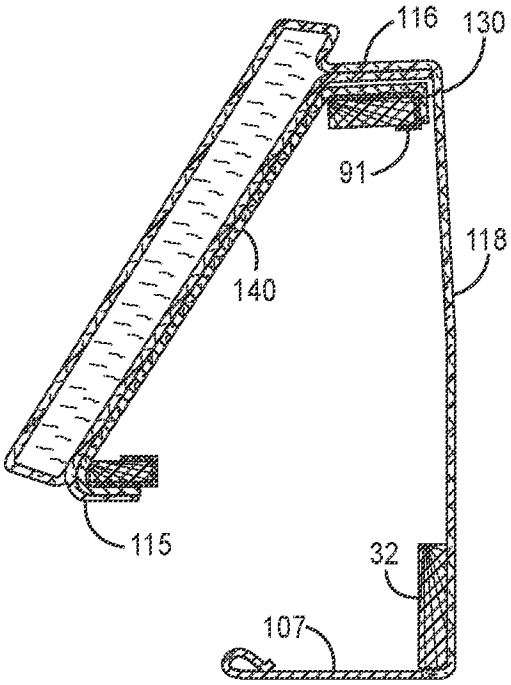
Figure 16B:
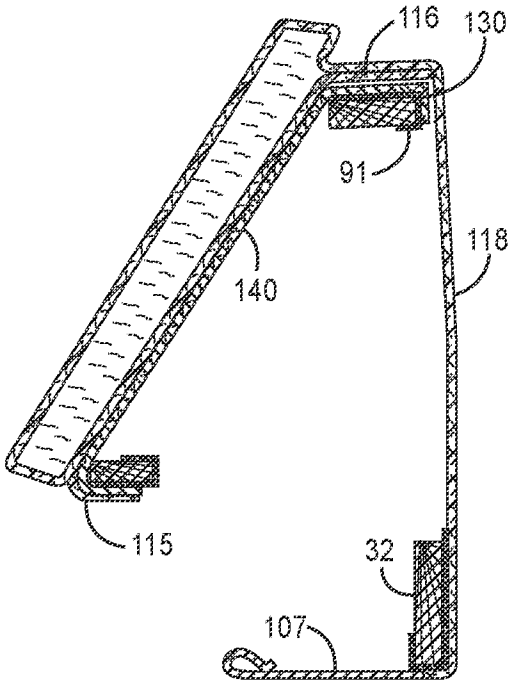
Figure 16E:
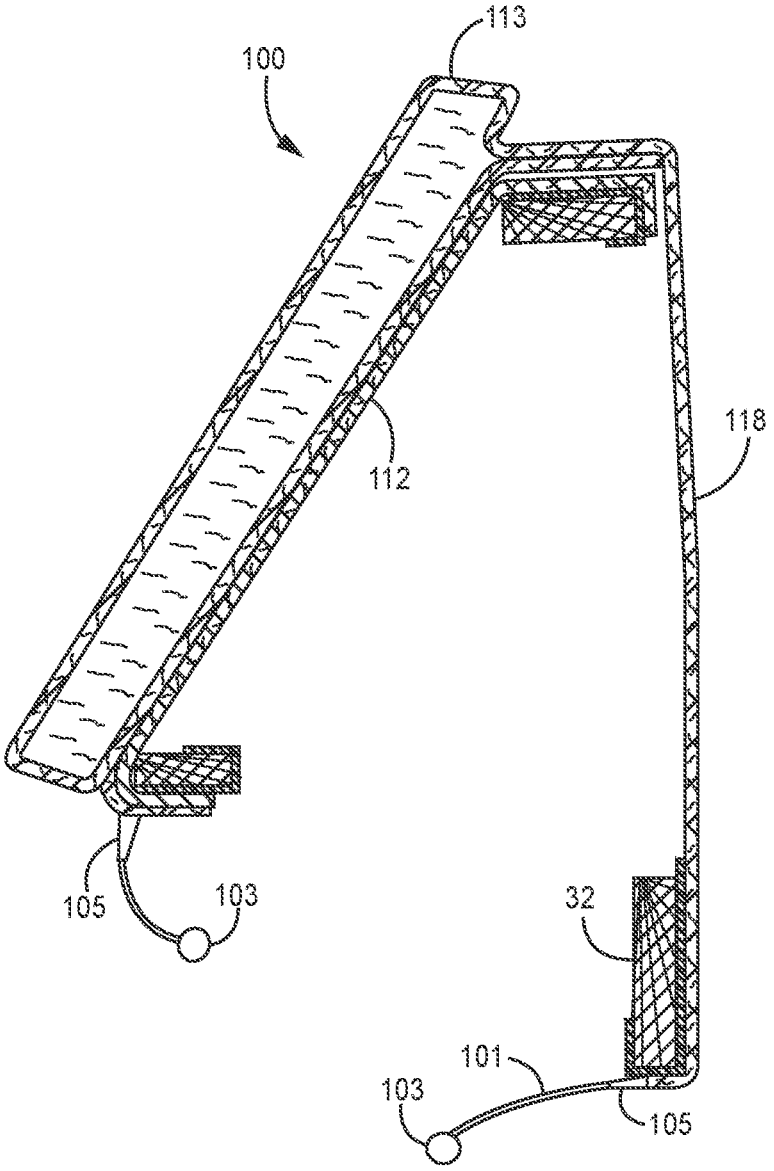

FIG. 14-15 illustrate a textile seat deck assembly 201 having a textile platform portion 190 including a forward edge portion 202, a rearward edge portion 203, a left side edge portion 204, and a right side edge portion 205. In some embodiments, at least one yoke member 209 is disposed proximate to rearward edge portion 203. In some embodiments, a plurality of straps 214 are coupled to at least one yoke member. In some embodiments, a plurality of straps 214 are affixed to a spring rail 230. In some embodiments, a left panel 207 is sewn or stitched along the left side edge 204 of a textile platform 190 extending substantially between the forward edge 202 and the rearward edge 203. In some embodiments, one or more fastener strips 91 are affixed to the left panel 207 extending substantially between the forward edge 202 and the rearward edge 203. In embodiments, a right panel 206 is sewn or stitched along the right side edge 205 of a textile platform 90 extending substantially between the forward edge 202 and the rearward edge 203. In some embodiments, one or more fastener strips 91 are affixed to the right panel 206 extending substantially between the forward edge 202 and the rearward edge 203. In some embodiments, a front upholstery panel 209 is sewn or stitched along the forward edge 202 of a textile platform 190 extending substantially between the left side edge portion 204 and the right side edge portion 205. In some embodiments, one or more fastener strips 91 are affixed to the front upholstery panel 209, such as by stitching 254, the panel 209 extending substantially between the left side edge 204 and the right edge 205. Additional padding material 280 may be disposed between the front panel 274 and the front upholstery panel 209. In some embodiments, the additional padding material may be sewn or stitched along the forward edge 202 of a textile platform 190 extending substantially between the left side edge portion 204 and the right side edge portion 205. In some embodiments, the additional padding may share a common stitch with the front upholstery panel 209.

In some embodiments, one or more elastic fasteners 101 are affixed to the left panel 207 along the edge portion. In embodiments, left panel 207 has one or more fabric loops 105 allowing one or more elastic fasteners 101 affixed to portions of the cover to pass through. In some embodiments, one or more elastic fasteners 101 are affixed to the right panel 206 along the edge portion. In some embodiments, one or more elastic fasteners 101 are affixed to the front upholstery panel 209, such as by stitching 254, the panel 209 extending substantially between the left side edge 204 and the right edge 205. FIGS. 14-15 are offered by way of illustration only. Additional embodiments wherein a seat deck assembly 201 has different combinations of fastener strips 91, elastic fasteners 101, and pulls 107.

Assembly

Any combination of the described fastening means may be used in assembling a sofa in accordance with this disclosure. For example, a textile seat deck assembly 201 may include any combination of fastener strips 91 and elastic fasteners 101. Different wood sofa frames may also necessitate various combinations of fastener strips 91 and elastic fasteners 101. In some instances, a "cover to cover" assembly method is employed where fastening means extends around a frame member and engages with a component, such as a second fastener or tab, directly affixed to another portion of the upholstery. In some instances, a "cover to frame" assembly method is employed where fastening means attach portions of the upholstery kit directly to the wood sofa frame. Example configurations are illustrated below.

FIGS. 16A-16E illustrate fastener strips 91 engaging the form fit upholstery cover 100 to members of the wood sofa frame 22. For example, fastener strips 91 may be used to engage the form fit upholster cover to the breast rail 28, the top rail 26, and the back panel frame member 32 of the wood frame 22, in addition to other members. In embodiments, fastener stripping comprises one or more fastener strips 91 engaged with the breast rail 28 such that the one or more fastener strips 91 are disposed around at least two corners of the breast rail 28 capturing the breast rail. The length of the one of more fastener strips 91 may be limited by vertical wood sofa frame members 39 which intersect with the breast rail 28. In some embodiments, one or more fastener strips 91 secures a first material panel 112 of a form fit upholstery cover 100 to a breast rail 28 such that the first material panel 112 covers at least three corners of the breast rail 28. In some embodiments, a form fit upholstery cover 100 may be stapled or similarly fastened directly to the breast rail 28 without the use of fastener strip 28. In embodiments, a form fit upholstery cover 100 may be stapled or similarly fastened directly to the breast rail 28 in addition to using the one or more fastener strips 91. In some embodiments, one or more fastener strips 91 engage with a top rail 26 such that the one or more fastener strips 91 are disposed around at least two corners 130 of the top rail 26. The length of the one of more fastener strips 91 may be limited by wood sofa frame members which intersect with the top rail 26. In such instances, cardboard strips, not shown, may be disposed between the one or more fastener strips 91 to supply additional rigidity to the upholstery material. In some embodiments, fastener stripping 91 secures a top edge 116 of a form fit upholstery cover 100 around a top rail 26 such that the form fit upholstery cover 100 covers at least three corners 130 of the top rail 26. The one or more fastener strips 91 may be positioned such that the first material panel 112 is held taught between the breast rail 28 and the top rail 26. When sufficient longitudinal force is exerted, the channel 95 of the one or more fastener strips 91 may be slid along the breast rail 28 or the top rail 26 to smooth out any wrinkles visible in the back material panel 118. In some embodiments, the one or more fastener strips 91 conforms the back material panel 118 around all exposed visible edges of the breast rail 28 and the top rail 26 creating an aesthetic that can be appreciated by the user.

The fastener strips 91 may also, in embodiments, support straps 140 which substantially support the sofa user's back. The straps 140 are sewn into the cover 100 and onto the fastener strips 91. In embodiments, straps 140 may be affixed directly to the breast rail 28, for example, with staples or similar means.

In some embodiments, one or more fastener strips 91 engage with a back panel frame member 132 such that the one or more fastener strips 91 are disposed around at least two corners 130 of the back panel frame member 132. The length of the one of more fastener strips 91 may be limited by furniture frame members which intersect with the back panel frame member 132. In some embodiments, fastener stripping 91 secures a back material panel 118 of a form fit upholstery cover 100 around a back panel frame member 132 such that the form fit upholstery cover 100 covers at least three corners of the back panel frame member 132. The one or more fastener strips 91 may be positioned such that the back material panel 118 is held taught between the back panel frame member 132 and the top rail 26. In some embodiments, the one or more fastener strips 91 conforms the back material panel 118 around all exposed visible edges of the back panel frame member 132 creating an aesthetic that can be appreciated by the user.

In some embodiments, the fastener is one or more pulls 107 stitched or otherwise affixed to the edge portion of back material panel 118. In some embodiments, the fastener is one or more elastic fasteners 101 attached directly to an edge portion of the back material panel 118 such as through, eyelets, fabric pieces 105, or perforations in the material. The fastener is drawn underneath the sofa frame 22 and forms a taught connection with a corresponding fastener secured to an edge portion of front upholstery panel 209. The fastener may be positioned such that the back material panel 118 is held taught between the back panel frame member 32 and the top rail 26 when the opposite end of the fastener is securely engaged with a corresponding fastener secured to an edge portion of front upholstery panel 209. In embodiments, the fastener conforms the back material panel 118 around all exposed visible edges of the back panel frame member 32 creating an aesthetic that can be appreciated by the user. In embodiments, a rod or other rigid material, such as an elongate polymer strip, may be affixed to an edge portion of the back material panel 118, thereby ensuring the edge portion of the cover does not bunch up in any one area along the sofa frame 22. In embodiments, the edge portion of the cover may be folded around the rod or other rigid material and stitched, thereby securing the rod or other rigid material in place. In embodiments, the edge portion of the cover may be folded back and stitched into place, defining a pocket into which a rod or other rigid material may be slid. In embodiments, the elastic fastener 101 may be secured about the rod or other rigid material.

Regarding the seat deck assembly 201, the one or more fastener strips 91 affixed to the right panel 206 may be rigidly engaged to the aperture 72 in right side 73, and the one or more fastener strips 91 affixed to the left panel 207 may capture the side board 250 of the sofa frame 180. In some embodiments, one or more fastener strips 91 engage with a bottom edge 69 of the front panel 274 such that the one or more fastener strips 91 are disposed around at least two corners 277 of the front panel 274. The length of the one of more fastener strips 91 may be limited by furniture frame members which intersect with the front panel 274. When sufficient longitudinal force is exerted, the channel 95 of the one or more fastener strips 91 may be slid along the bottom edge 279 of front panel 274 to properly fit front upholstery panel 209. In some embodiments, the one or more fastener strips 91 conforms the front material panel 209 around all exposed visible edges of the front panel 274 creating an aesthetic that can be appreciated by the user.

In embodiments, the left panel 207 may be secured in place as one or more elastic fasteners 101 engage with frame members of the wood sofa frame 22. In embodiments, one or more elastic fasteners 101 affixed to the right panel 206 may pass through aperture 72 in right side 73 and engage with corresponding receiving holes in right side 73. In embodiments, elastic fasteners 101 attached to front upholstery panel 209 are secured underneath the wooden sofa frame 180. In some embodiments, one or more elastic fasteners 101 attached to front upholstery panel 209 are pulled across the bottom of the wooden sofa from and engage with corresponding fabric loops affixed along the edge portion of the back cover. In other embodiments, the one or more elastic fasteners 101 attached to front upholstery panel 209 are tied to the anchor member of elastic fasteners affixed along the edge portion of the back cover.

Figure 17:
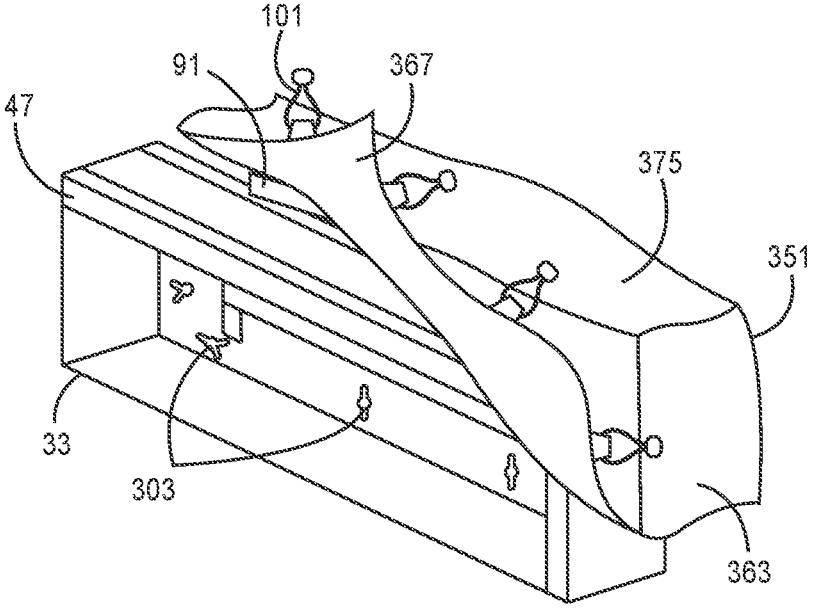
FIG. 17 is an arm rest cover being disposed about an arm rest of a sofa frame according to embodiments of the disclosure.

Arm rest covers may contain any combination of fastener strips 91 and elastic fasteners 101. FIG. 17 illustrates an arm rest cover 351 being pulled over right arm rest 33 and having elastic fasteners 101 along peripheral edge portions of the arm rest cover 351. The outside material panel 367 is pulled back to reveal a fastener strip 91 affixed along the portion where the top material panel 375 and outside material panel 367 meet and is further configured to engage cross bar member 47. In embodiments, elastic fasteners 101 may be pulled around the frame members of arm rest 33 and engage corresponding anchor member receiving portions 303. In embodiments, elastic fasteners 101 may engage corresponding tabs (not shown) stitched to portions of the arm rest cover 351 in a "cover to cover" configuration. In embodiments, elastic fasteners 101 may be fed through components attached to other upholstery kit pieces thereby enhancing the security of all attachment points and ensuring upholstery kit components are firmly held in place. In embodiments, cardboard or other semi-rigid material, not shown, may be affixed between cross bar member 47 and right side 73 to support top material panel 375 and any additional cushioning installed therebetween.

Figure 18:
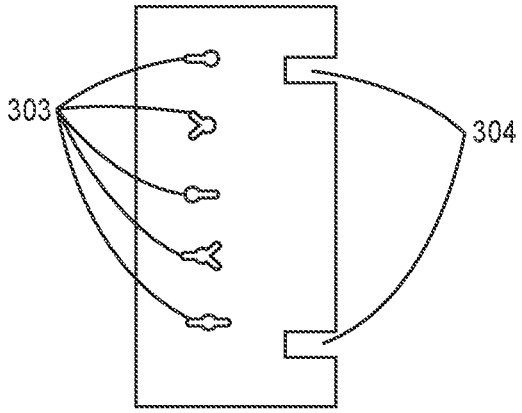
FIG. 18 is a view of holes and notches through a sofa frame member according to embodiments of the disclosure.
Figure 19:
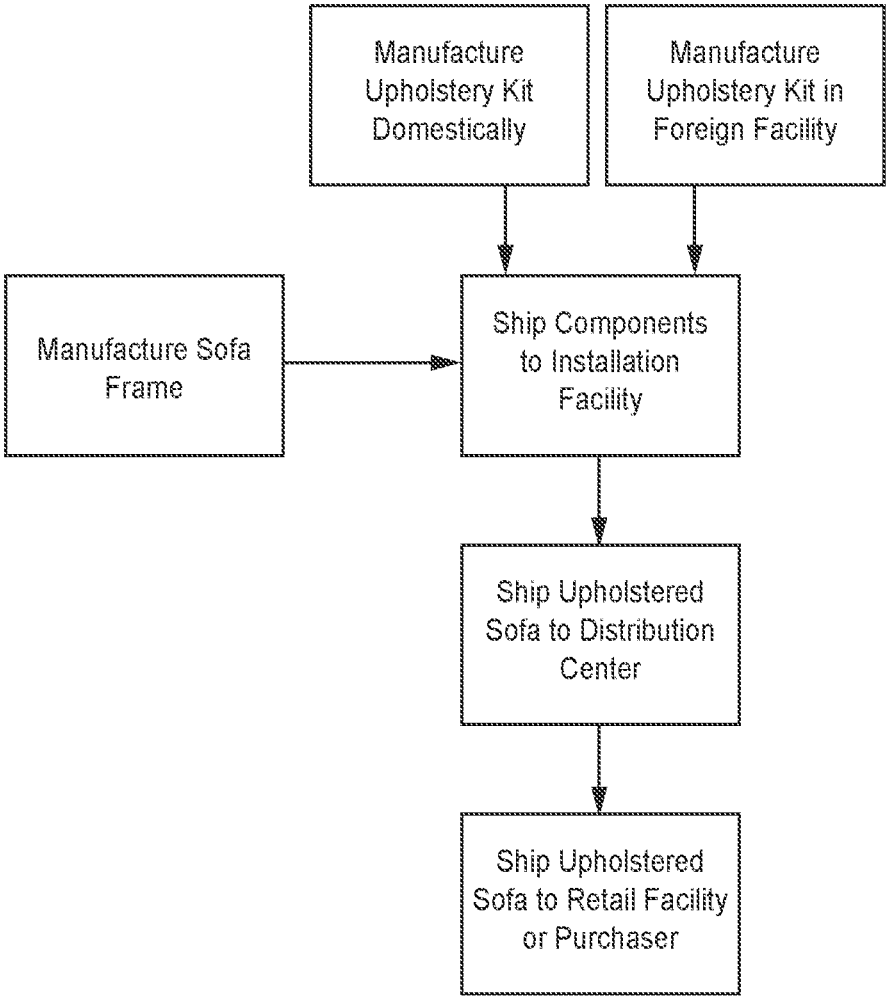
FIG. 19 is a method of manufacturing an upholstered sofa according to embodiments of the disclosure.
Figure 20:
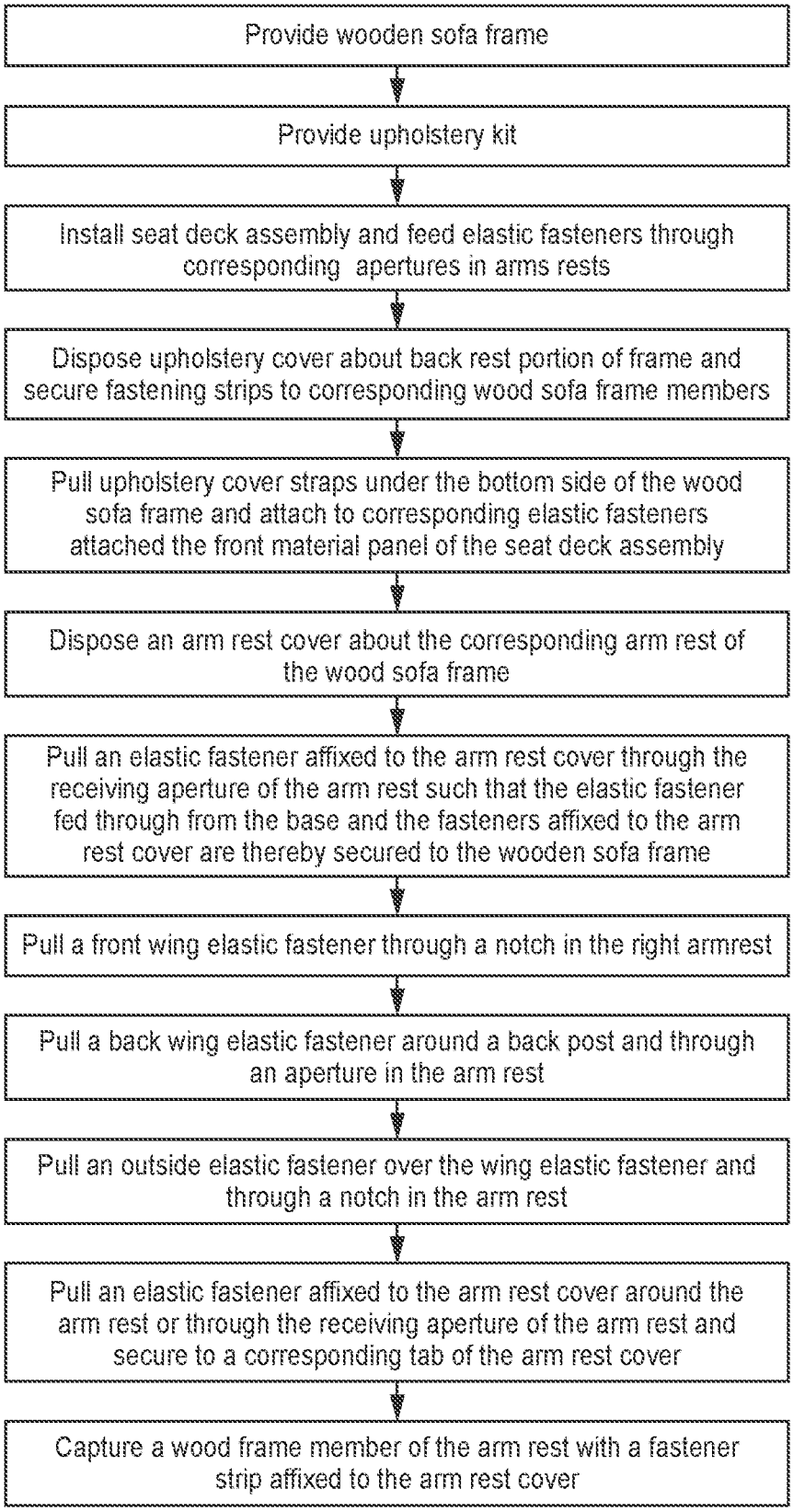
FIG. 20 is a method of assembling an upholstered sofa according to embodiments of the disclosure.

FIG. 18 illustrates a sample frame member of the sofa frame 22 having anchor member receiving portions designed to accept and retain the anchor member 103 of an elastic fastener 101. In some embodiments, the anchor member receiving portion may be a notch 304 along an edge of a frame member such that an elastic fastener 101 may be pulled from a first side of a frame member and around the edge of the frame member, such that the elastic cord 102 aligns with and fits into the notch 304. The anchor member 103 of the elastic fastener 101, being wider than the notch 304, remains on an opposite side of the frame member and held in place under the force of elastic cord 102 shrinking back to its original unextended size. In some embodiments, the anchor member receiving portion is defined by a hole 303 through the frame member, the hole 303 further having one or more slots extending radially from the hole 303. The hole 303 is wide enough to permit the anchor member 103 of an elastic fastener 101 from one side of the frame member to an opposite side of the frame member. The radial slot is wide enough to permit the elastic cord 102 to pass from one side of the frame member to an opposite side of the frame member, yet the radial slot is too narrow to permit the anchor member 103 to pass from one side of the frame member to an opposite side of the frame member. This permits an installer to secure an elastic fastener 101 to a frame member of the sofa frame 22 by exerting sufficient force to pull the anchor member 103 of the elastic fastener 101 completely through the anchor member receiving portion and then guiding the cord into the radial slot. When the installer releases the elastic fastener 101, the force of elastic cord 102 returning to its previous unextended state is sufficient to pull the anchor member 103 against the frame member, thereby securing it in place, as the anchor member 103 is unable to return through the radial slot.

The embodiments of the present disclosure can provide the following advantages that can reduce installer training or errors during installation. In embodiments, an anchor member receiving portion may be strategically placed on a frame member of a sofa frame 22 in such a manner that the anchor member receiving portion may only be reached by a single elastic fastener 101, thereby eliminating the possibility that an installer would secure the wrong elastic fastener 101 to the anchor member receiving portion. In another embodiment, the length of the elastic cord 102 can be predetermined such that the elastic fastener 101 can only reach a single anchor member receiving portion, thereby eliminating the possibility that an installer would secure the elastic fastener 101 to the wrong anchor member receiving portion. In other embodiments, the elastic fastener 101 and anchor member receiving portion can be color coded or labeled with a letter, shape, or other symbol to reduce installer error. For example, a red elastic fastener 101 might be matched with a red hole 303 while a blue elastic fastener 101 is matched with a blue notch 304. In another example, the elastic fastener 101 may be labelled with a letter "A," and matched to a anchor member receiving portion with a similar letter "A." In embodiments, the anchor member 103 may be color coded or labelled. In embodiments, the anchor member receiving portion may have multiple colors or labels. For example, a hole 303 may have a first radial slot with a first label and a second radial slot with a second label.

Installers may take additional measures, not shown, in furtherance of the goal of creating an aesthetically pleasing upholstered sofa. For example, exposed seams and loose edges are generally unsightly. Such unsightly portions might exist where different pieces of the upholstery kit abut one another. For example, on the back side of the sofa, an unsightly seam might exist where an upholstery cover abuts an arm rest cover. This unsightly seam might be hidden, for example, by having the upholstery cover slightly overlap the arm rest cover, and placing strips of hook and loop fasteners along the overlapping portions of the covers so that the hook and loop fasteners hold the covers together yet are hidden from the user's view. The portion of the hook and loop fastener closer to the wood sofa frame could be stapled or otherwise affixed to the frame such that when the cover portions are connected they are held taught. In another example, a dust cover, such as cambric or other known materials, could be stretched across the bottom of the sofa and affixed to the frame with staples or other similar fasteners. The dust cover would hide unsightly fastening means such as straps, elastic fasteners, and fastening strips, as well as other unsightly components such as raw wood frame members or the underside of a textile deck assembly. The fasteners used to secure the dust cover may be further useful in ensuring that components of the upholstery kit do not slide on the frame after installation, thereby maintaining its aesthetically pleasing appearance for a longer period of time. It is further understood that installers may use staples or other alternative fastening means on portions of the upholstery kit that are not conducive to the use of elastic fasteners or fastener strips according to embodiments of this disclosure. Installers may also use staples or other alternative fastening means as anchor points or starting points when disposing pieces of the upholstery kit about a wood sofa frame.

Upholstery kits may be manufactured domestically or in foreign factories. In some instances, advantages such as cheaper upholstery materials or cheaper textile labor may offset shipping costs to ship upholstery kits from foreign manufacturing facilities to domestic assembling facilities. Wood sofa frames, because of their weight and bulk, and not so easily shipped overseas and are generally manufactured domestically. Assembled frames and upholstery kits may be received by an installer to attach the upholstery kit to the wood sofa frame in accordance with embodiments of this disclosure. In some instances, the wood sofa frame manufacturing site may also act as the location for installation. A fully assembled upholstered sofa may then be shipped to a distribution center. In some instances, a distribution center may be 100 miles or further from the installation site. In some instances, a distribution center may also serve as a retail facility. From the distribution center, a fully assembled upholstered sofa may be shipped either to a retail facility or directly to the home of a purchaser. In some instances, retail facilities or purchaser homes may be located 100 miles or more from the distribution center.

U.S. Patent and Publication Nos. U.S. Pat. Nos. 10,117,521; 10,034,554; and 2014/0375103 are incorporated by reference herein for all purposes.

While the disclosure is amenable to various modifications and alternative forms, specifics thereof have been shown by way of example in the drawings and described in detail. It is understood however, that the intention is not to limit the application to the particular embodiments described. On the contrary, the intention is to cover all modifications, equivalents, and alternative falling with the spirit and scope of the disclosure as defined by the appended claims.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art. Use of "end" and "edge" herein includes the end and edge regions proximate the geometric edge.

References to "embodiment(s)", "disclosure", "present disclosure", "embodiment(s) of the disclosure", "disclosed embodiments", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

The invention claimed is:

1. An upholstered sofa comprising:

a sofa frame comprising a right arm rest frame portion and a left arm rest portion with a plurality of wood frame members extending therebetween and an upright back rest frame positioned therebetween, the upright back rest frame including a top rail; and a form fit upholstery cover disposed on the back rest frame portion and being attached to the top rail with one or more elongate resilient polymer fastening strips with two internal corners and a channel opening between 10 and 25 millimeters, the one or more elongate resilient polymer fastening strips aligned and extending most of the length of the top rail.

2. The upholstered sofa of claim 1, wherein the upholstery cover is formed of upholstery material and the one or more elongate resilient polymer fastening strips are attached to upholstery material by stitching.

3. The upholstered sofa of claim 1, wherein the upholstery cover further has an edge portion with a plurality of spaced elastic cords under tension for maintaining the tautness of the upholstery cover.

4. The upholstered sofa of claim 1, wherein each of the right arm rest portion and left arm rest portion are formed of polymer.

5. The upholstered sofa of claim 1, wherein the upholstery cover has a back rest pocket conformingly sized for the back rest frame portion of the sofa frame, the back rest pocket having padding incorporated therein and further comprising a plurality of back rest webbing straps.

6. The upholstered sofa of claim 1, wherein each of the right arm rest portion and left arm rest portion are blow molded from a polymer.

7. A method of assembling an upholstered sofa comprising:

providing a sofa frame having a right arm rest frame portion and a left arm rest portion and having a plurality of wood frame members extending therebetween, the sofa frame having an upright back rest frame positioned therebetween, the upright back rest frame including a top rail, the sofa frame defining a rectangular seat box;

providing a form fit upholstery cover assembly formed of upholstery material and having a rearward lower edge portion and a forward lower edge portion, one of the rearward lower edge portion and the forward lower edge portion having a spaced plurality of at least four elastic cords, each elastic cord attached to the upholstery at a proximal end and having a rigid connector at a distal end; and placing the form fit upholstery cover assembly over the wooden sofa frame and attaching each of the rigid connectors by elongating the respective elastic cord and attaching the rigid connector to one of the sofa frame and the other of the rearward lower edge portion and the forward lower edge portion.

8. The method of claim 7, further comprising attaching a further edge portion of the upholstery cover assembly to a frame member by an elongate polymer channel sewn to the upholstery material, the elongate polymer channel extending around three sides of the frame member.

9. The method of claim 7, further comprising forming the left arm rest frame member and right arm rest frame member by blow molding.

10. The method of claim 9, wherein the upholstery cover assembly comprises two arm rest covers, and the method comprises extending each arm rest cover around four sides of respective ones of the left arm rest frame portions and the right arm rest frame portion.

11. The method of claim 10, further comprising connecting opposite edge portions of each arm rest cover by a plurality of elastic cords.

12. The form fitted upholstery cover of claim 7, wherein the cover has a back rest pocket conformingly sized for the back rest frame portion of the sofa frame, the back rest pocket having padding incorporated therein and further comprising a plurality of back rest webbing straps and the method comprises affixing the straps to the sofa frame.

13. A method of assembling an upholstered sofa comprising:

providing a sofa frame having a right arm rest frame portion and a left arm rest frame portion and having a plurality of wood frame members extending therebetween, the sofa frame having an upright back rest frame positioned therebetween, the upright back rest frame including a top rail, the sofa frame defining a rectangular seat box;

providing a form fit upholstery cover comprising upholstery material and having one or more elongate resilient polymer fastening strips with two internal corners and a channel opening between 10 and 25 millimeters, the one or more elongate resilient polymer fastening strips attached to the upholstery material by stitching; and attaching the form fit upholstery cover to the sofa frame by attaching the one or more elongate resilient polymer fastening strips to the top rail.

14. The method of claim 13, wherein the top rail has a length and the method further comprises attaching the elongate resilient polymer fastening strips substantially the entire length of the top rail.

15. The method of claim 13, further comprising blow molding each of the left and right arm rest frame portions.

16. The method of claim 13, wherein the form fit upholstery cover has a rearward lower edge portion and a forward lower edge portion, one of the rearward lower edge portion and the forward lower edge portion having a spaced plurality of at least four elastic cords, each elastic cord attached to the upholstery at a proximal end and having a rigid connector at a distal end and the method further comprises and attaching each of the connectors by elongating the respective elastic cord and attaching to one of the sofa frame and the other of the rearward lower edge portion and the forward lower edge portion.

* * * * *